US011015596B2

(12) United States Patent
Lee et al.

(10) Patent No.: US 11,015,596 B2
(45) Date of Patent: May 25, 2021

(54) SCROLL COMPRESSOR SEALING

(71) Applicant: LG ELECTRONICS INC., Seoul (KR)

(72) Inventors: Howon Lee, Seoul (KR); Jungsun Choi, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 443 days.

(21) Appl. No.: 15/876,396

(22) Filed: Jan. 22, 2018

(65) Prior Publication Data

US 2018/0172004 A1 Jun. 21, 2018

Related U.S. Application Data

(63) Continuation-in-part of application No. 15/451,803, filed on Mar. 7, 2017, now Pat. No. 10,697,456.

(30) Foreign Application Priority Data

Apr. 26, 2016 (KR) ..... 10-2016-0051051

(51) Int. Cl.
*F04C 18/02* (2006.01)
*F04C 23/00* (2006.01)
(Continued)

(52) U.S. Cl.
CPC ..... *F04C 18/0215* (2013.01); *F01C 19/005* (2013.01); *F04C 18/0253* (2013.01);
(Continued)

(58) Field of Classification Search
CPC ... F01C 19/005; F04C 18/0253; F04C 27/008
See application file for complete search history.

(56) References Cited

U.S. PATENT DOCUMENTS 5,212,964 A 5/1993 Utter et al.
5,263,822 A 11/1993 Fujio
(Continued)

FOREIGN PATENT DOCUMENTS

CN 1071179 A * 4/1993
CN 1131238 9/1996
(Continued)

OTHER PUBLICATIONS

Machine translation from Google of the Chinese Patent Publication: CN1071179A, Title: Carbon-fibre reinforced polytetrafluorethylene sealing material and its production, published on Apr. 21, 1993. (Year: 1993).*

(Continued)

*Primary Examiner* — Mary Davis
(74) *Attorney, Agent, or Firm* — Fish & Richardson P.C.

(57) ABSTRACT

A scroll compressor includes: a frame configured to support a second scroll by being coupled to a first scroll; a sealing member insertion groove formed in a ring shape, on at least one of one side surface of the second scroll and one side surface of the frame contacting the second scroll; and a sealing member formed in a ring shape, inserted into the sealing member insertion groove, and configured to divide an interval between the second scroll and the frame in a radial direction, wherein the sealing member is formed such that a sectional surface of an inner circumferential surface thereof is smaller than that of an outer circumferential surface thereof, and such that a second gap between the outer circumferential surface of the sealing member and an outer side wall surface of the sealing member insertion groove is smaller than or equal to a first gap between the inner circumferential surface of the sealing member and an inner side wall surface of the sealing member insertion groove.

20 Claims, 16 Drawing Sheets

(51) Int. Cl.
*F04C 27/00* (2006.01)
*F01C 19/00* (2006.01)

(52) U.S. Cl.
CPC ..... *F04C 23/008* (2013.01); *F04C 27/005* (2013.01); *F04C 27/008* (2013.01)

(56) References Cited

U.S. PATENT DOCUMENTS

| | | | | |
|---|---|---|---|---|
| 6,695,599 | B2 * | 2/2004 | Uchida | F04C 27/005 418/55.4 |
| 7,614,860 | B2 | 11/2009 | Yano et al. | |
| 7,950,913 | B2 * | 5/2011 | Suefuji | F01C 1/084 277/549 |
| 10,697,456 | B2 * | 6/2020 | Lee | F04C 27/008 |

FOREIGN PATENT DOCUMENTS

| | | |
|---|---|---|
| CN | 101802407 | 8/2010 |
| CN | 202431523 | 9/2012 |
| EP | 2863059 | 4/2015 |
| JP | 1991105090 | 5/1991 |
| JP | 07-247967 | 9/1995 |
| JP | 11-182462 | 7/1999 |
| JP | 2002054583 | 2/2002 |
| JP | 2009-097356 | 5/2009 |
| JP | 200997350 | 5/2009 |
| JP | 2009097356 | 5/2009 |
| KR | 20-2000-0015867 | 8/2000 |
| KR | 10-2005-0082632 | 8/2005 |
| KR | 10-2008-0090009 | 10/2008 |

OTHER PUBLICATIONS

Extended European Search Report in European Application No. 17789742.8, dated Nov. 27, 2019, 7 pages.
International Search Report dated Apr. 18, 2017 issued in Application No. PCT/KR2017/000274.
Chinese Office Action in Chinese Application No. 201780024394.6, dated May 13, 2019, 15 pages (with English translation).

* cited by examiner

SCROLL COMPRESSOR SEALING

CROSS-REFERENCE TO RELATED APPLICATION(S)

This application is a Continuation-in-part of co-pending U.S. application Ser. No. 15/451,803 filed on Mar. 7, 2017 which claims priority under 35 U.S.C. 119(a) to Application No. 10-2016-0051051, filed in the Republic of Korea on Apr. 26, 2016, which are hereby incorporated by reference in their entirety.

BACKGROUND

1. Field

This specification relates to a scroll compressor, and more particularly, a scroll compressor where a compression part is disposed below a motor part.

2. Background

A scroll compressor is a compressor forming a compression chamber made of a suction chamber, an intermediate pressure chamber, and a discharge chamber between both scrolls while the plurality of scrolls perform a relative orbiting motion in an engaged state. Such a scroll compressor may obtain a relatively high compression ratio as compared with other types of compressors while smoothly connecting suction, compression, and discharge strokes of refrigerant, thereby obtaining stable torque. Therefore, the scroll compressor is widely used for compressing refrigerant in an air conditioner or the like. Recently, a high-efficiency scroll compressor having a lower eccentric load and an operation speed at 180 Hz or higher has been introduced.

The scroll compressor may be categorized into a low pressure type where a suction pipe is communicated with art inner space of a casing which forms a low pressure part, and a high pressure type where a suction pipe is directly communicated with a compression chamber. Accordingly, in case of the low pressure type, a driving unit is installed at a suction space, a low pressure part. On the other hand, in case of the high pressure type, a driving unit is installed at a discharge space, a high pressure part.

Such a scroll compressor may be categorized into an upper compression type and a lower compression type according to a position of a driving unit and a compression unit. In case of the upper compression type, a compression unit is positioned above a driving unit. On the other hand, in case of the lower compression type, a compression unit is positioned below a driving unit.

In the scroll compressor, a gas force is applied in a direction that an orbiting scroll becomes far from a fixed scroll, as a pressure of a compression chamber is increased. As a result, leakage from a space between compression chambers occurs as the orbiting scroll becomes far from the fixed scroll. This may cause a compression loss.

Considering this, a tip seal method or a back pressure method has been applied to the scroll compressor. The tip seal method is used to insert a sealing member to a fore end of a fixed wrap and an orbiting wrap. And the back pressure method is used to pressurize an orbiting scroll or a fixed scroll towards another scroll by a pressure of a back pressure chamber forming an intermediate pressure or a discharge pressure and formed on a rear surface of the orbiting scroll or the fixed scroll.

Especially, in case of the back pressure method, a sealing member is installed between a rear surface of the orbiting scroll (or a rear surface of the fixed scroll) and a corresponding frame, and a back pressure chamber is formed inside or outside the sealing member. According to the back pressure method using a sealing member, a ring-shaped groove is formed at one member which forms a thrust surface, and a ring-shaped sealing member having a quadrangular sectional surface is inserted into the ring-shaped groove. As a result, a refrigerant of an intermediate pressure, compressed in a compression chamber when the compressor is operated, is introduced into the ring-shaped groove. And the sealing member is upward moved by the intermediate pressure to thus be adhered to another member, thereby forming a back pressure chamber.

However, in the conventional scroll compressor, a high sealing effect may be obtained in an axial direction, as the sealing member is upward moved towards another member by an intermediate pressure and contacts the another member. However, since the sealing member is formed in a ring shape, refrigerant leakage occurs from a gap between an outer circumferential surface of the sealing member and an outer side wall surface of the ring-shaped groove, in a case where a back pressure chamber is formed inside the sealing member. On the other hand, in a case where a back pressure chamber is formed outside the sealing member, refrigerant leakage occurs from a gap between an inner circumferential surface of the sealing member and an inner side wall surface of the ring-shaped groove. This may cause the back pressure chamber not to be effectively formed. The reason is as follows. In order for the sealing member to move in an axial direction, a radial interval is required between an inner circumferential surface of the sealing member and an inner side wall surface of the ring-shaped groove, or between an outer circumferential surface of the sealing member and an outer side wall surface of the ring-shaped groove. However, since the sealing member is formed in a ring shape having a quadrangular sectional surface, the sealing member cannot be contracted in a radial direction.

Further, in the conventional scroll compressor, since the sealing member is formed to have a quadrangular sectional surface, the sealing member has an increased weight. This may cause the sealing member not to be rapidly upward-moved when the scroll compressor is initially driven, resulting in delaying in forming a back pressure chamber. Further, if an axial thickness of the sealing member is small, a radial sealing area may be reduced, and the sealing member may have a shortened lifespan due to abrasion with another member. On the other hand, if a radial width of the sealing member is small, an axial sealing area may be reduced, and an area of the sealing member where an upward-movement pressure is applied with respect to a weight may be reduced. This may cause delay of an upward movement of the sealing member.

Further, in the conventional scroll compressor, as disclosed in Korean Laid-Open Patent No. 10-2008-0090009, an intermediate part of a ring-shaped sealing member is cut-out such that the sealing member is widened a little in a radial direction when it is upward moved. However, in this case, a pressure of a back pressure chamber leaks through the cut-out part, resulting in a limitation that the pressure of the back pressure chamber is not constantly maintained. If the pressure of the back pressure chamber is not constant, the orbiting scroll may have an unstable behavior. This may lower a sealing force with respect to a compression chamber between the orbiting scroll and the fixed scroll, resulting in increasing a compression loss.

The above references are incorporated by reference herein where appropriate for appropriate teachings of additional or alternative details, features and/or technical background.

SUMMARY OF THE INVENTION

Therefore, an aspect of the detailed description is to provide a scroll compressor capable of obtaining a high axial sealing force and a high radial sealing force, by forming a sealing member in a ring shape and by forming the sealing member to have a displacement in a radial direction.

Another aspect of the detailed description is to provide a scroll compressor capable of forming a sealing member in a ring shape, and capable of forming a back pressure chamber within a short time by rapidly upward-moving the sealing member.

Another aspect of the detailed description is to provide a scroll compressor capable of reducing a weight of a sealing member, obtaining a radial sealing area and an axial sealing area, and obtaining a thickness of the sealing member against abrasion.

Another aspect of the detailed description is to provide a scroll compressor capable of stabilizing a behavior of an orbiting scroll by enhancing a sealing effect of a sealing member, and capable of preventing refrigerant leakage from a compression chamber.

To achieve these and other advantages and in accordance with the purpose of this specification, as embodied and broadly described herein, there is provided a scroll compressor, including: a sealing member inserted into a ring-shaped groove formed at one of two members which perform a sliding motion with respect to each other, and configured to perform a sealing function between contact surfaces of the two members while being upward moved by a pressure difference, wherein the sealing member is formed in a ring shape and is formed to have a "¬"-shaped sectional surface, and wherein an outer diameter of the sealing member is smaller than that of the ring-shaped groove for inserting the sealing member.

The sealing member is formed as a single body having no cut-out portion.

The part "]" which forms a radial sealing portion contacting an outer side wall surface of the ring-shaped groove is formed to be relatively thinner than the part '-' which forms an axial sealing portion by contacting a thrust surface of an opposite member.

According to another aspect of the present invention, there is provided a scroll compressor, comprising: a first scroll; a second scroll which forms a compression chamber together with the first scroll while performing an orbiting movement with respect to the first scroll; a frame configured to support the second scroll by being coupled to the first scroll; a sealing member insertion groove formed in a ring shape, on at least one of one side surface of the second scroll and one side surface of the frame contacting the second scroll; and a sealing member formed in a ring shape, inserted into the sealing member insertion groove, and configured to divide an interval between the second scroll and the frame in a radial direction, wherein the sealing member is formed such that a sectional surface of an inner circumferential surface thereof is smaller than that of an outer circumferential surface thereof, and such that a second gap between the outer circumferential surface of the sealing member and an outer side wall surface of the sealing member insertion groove is smaller than or equal to a first gap between the inner circumferential surface of the sealing member and an inner side wall surface of the sealing member insertion groove.

The second gap is formed to be 0.05~1.0% with respect to an outer diameter of the sealing member.

A first chamfering portion is formed on at least one of an outer edge of the sealing member insertion groove and an outer edge of the sealing member.

The sealing member includes: a first sealing portion formed in a ring shape, and having one surface forming an axial sealing surface with the frame; and a second sealing portion extended from another surface of the first sealing portion in a ring shape, and having an outer circumferential surface forming a radial sealing surface with the outer side wall surface of the sealing member insertion groove. And an axial height of the first chamfering portion is formed to be smaller than or equal to an axial thickness of the first sealing portion.

The sealing member includes: a first sealing portion formed in a ring shape, and having one surface forming an axial sealing surface with the frame; and a second sealing portion extended from another surface of the first sealing portion in a ring shape, and having an outer circumferential surface forming a radial sealing surface with the outer side wall surface of the sealing member insertion groove. And an outer diameter of the first sealing portion is formed to be equal to an outer diameter of the second sealing portion.

The sealing member includes: a first sealing portion formed in a ring shape, and having one surface forming an axial sealing surface with the frame; and a second sealing portion extended from another surface of the first sealing portion in a ring shape, and having an outer circumferential surface forming a radial sealing surface with the outer side wall surface of the sealing member insertion groove. And an outer diameter of the first sealing portion is formed to be different from an outer diameter of the second sealing portion.

The second gap is formed to be 0.05~1.0% with respect to an outer diameter of the sealing member.

The sealing member is formed of Teflon (PEFE) mixed with carbon fibers.

The sealing member further includes a graphite material.

The sealing member is formed to have a '¬'-shaped sectional surface, and a part of the sealing member contacting the frame has a larger thickness than a part of the sealing member contacting the sealing member insertion groove.

A gap between the second scroll and the frame is formed such that an inner interval is larger than an outer interval in a radius direction based on the sealing member insertion groove. And a first passage for communicating the inner interval and the outer interval with each other is formed at the second scroll or the frame.

A second passage for communicating the outer interval with the compression chamber is formed at the first scroll or the frame.

According to another aspect of the present invention, there is provided a scroll compressor, comprising: a casing having an inner space where oil is stored; a driving motor provided at the inner space of the casing; a rotation shaft coupled to the driving motor; a frame provided below the driving motor; a first scroll provided below the frame, and having a first wrap on one side surface thereof; a second scroll having a sealing member insertion groove on a surface thereof contacting the frame, provided between the frame and the first scroll, having a second wrap engaged with the first wrap, eccentrically-coupled to the rotation shaft such that the rotation shaft is overlapped with the second wrap in a radial direction, and forming compression chambers at a space between the second scroll and the first scroll while performing an orbiting movement with respect to the first scroll; and a sealing member formed in a ring shape, inserted into the sealing member insertion groove, provided between the frame and the second scroll, and configured to divide an interval between the frame and the second scroll into an inner interval and an outer interval, wherein the sealing member is formed such that a sectional surface of an inner circumferential surface thereof is smaller than that of an outer circumferential surface thereof, and an outer diameter of the sealing member is smaller than that of the sealing member insertion groove.

A plurality of oil passages for guiding the oil stored in the casing to an outer circumferential surface of the rotation shaft are formed at the rotation shaft. And at least one of the plurality of oil passages is formed to be communicated with the inner interval separated from the outer interval by the sealing member.

The outer interval is communicated with a compression chamber which forms an intermediate pressure between a suction pressure and a discharge pressure, among the compression chambers. A communication passage for communicating the inner interval and the outer interval with each other is further provided at the second scroll or the frame. And a depressurizing unit is provided at the communication passage.

The interval between the frame and the second scroll is formed such that the outer interval is smaller than the inner interval. And a chamfering portion inclined towards the sealing member insertion groove is formed at an edge of the sealing member insertion groove contacting the outer interval.

The sealing member is formed to have a '¬'-shaped sectional surface, and an outer diameter of the sealing member is smaller than that of the sealing member insertion groove by 0.05~1.0%.

The sealing member is formed of Teflon (PEFE) mixed with carbon fibers.

The sealing member further includes a graphite material.

The scroll compressor according to the present invention may have the following advantages.

Firstly, as the sealing member provided between the second scroll and the frame is formed in a ring shape as a single body, the sealing member has a displacement in a radial direction by a pressure. This may enhance not only an axial sealing force but also a radial sealing fore of the sealing member, thereby preventing an operation delay when the scroll compressor is driven.

Further, as an interval between an outer circumferential surface of the sealing member and the sealing member insertion groove is optimized, the sealing member may be prevented from being excessively adhered to the sealing member insertion groove, and a radial sealing force may be obtained. This may allow a back pressure chamber to be formed within a short time as the sealing member is upward moved rapidly.

Further, as the sealing member has an enhanced sealing effect, the back pressure chamber may maintain a constant pressure. As a result, the orbiting scroll may have a stable behavior, and refrigerant leakage from the compression chamber may be prevented. This may enhance compression efficiency.

Further, as the sealing member has no cut-out portion, damage of the sealing member occurring when the sealing member is applied to a high compression-ratio compressor may be prevented. This may enhance reliability.

Further, since the sealing member includes the first and second sealing portions and the second sealing portion is formed to be thinner than the first sealing portion, the sealing member may have a reduced weight. This may allow the sealing member to be rapidly upward-moved even when the scroll compressor is initially driven, thereby enhancing compression efficiency.

Further, as the first sealing portion is formed to have a large thickness, a shortened lifespan of the sealing member due to abrasion may be prevented. Further, as the second sealing portion is formed to have a small thickness, the second sealing portion may be rapidly bent even when the scroll compressor is initially driven, resulting in forming a radial sealing portion.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The embodiments will be described in detail with reference to the following drawings in which like reference numerals refer to like elements wherein:

The accompanying drawings, which are included to provide a further understanding of the invention and are incorporated in and constitute a part of this specification, illustrate exemplary embodiments and together with the description serve to explain the principles of the invention.

In the drawings:

FIG. 1 is a longitudinal sectional view of a lower compression-type scroll compressor in accordance with the present invention;

FIG. 2 is a horizontal sectional view of a compression unit in FIG. 1;

FIG. 3 is a front view illustrating a part of a rotating shaft for explaining a sliding portion in FIG. 1;

FIG. 4 is a longitudinal sectional view illustrating an oil supply passage (oil feeding path) between a back pressure chamber and a compression chamber in FIG. 1;

FIG. 5 is a perspective view showing a sealing member disassembled from a scroll in FIG. 1;

FIG. 6 is a planar view showing an inserted state of the sealing member of FIG. 5 into a sealing member insertion groove;

FIG. 7 is a sectional view taken along line 'V-V' in FIG. 6;

FIG. 8A is a graph showing a compression ratio according to a driving time when a scroll compressor having a sealing member according to this embodiment is normally operated;

FIG. 8B is a graph showing a compression ratio according to a driving time when an operation of the scroll compressor having a sealing member according to this embodiment is delayed;

FIG. 9 is a graph showing a change of a compression ratio according to a ratio (%) of a radial interval of a sealing member with respect to an outer diameter of a sealing member insertion groove, in a scroll compressor having a sealing member according to this embodiment;

FIG. 10 is a schematic view for explaining a size of a sealing member according to this embodiment;

Figure 11:
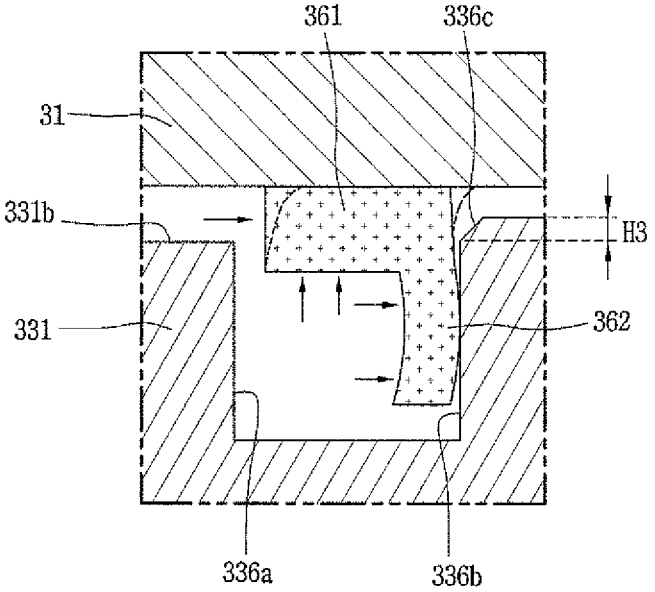
Figure 12:
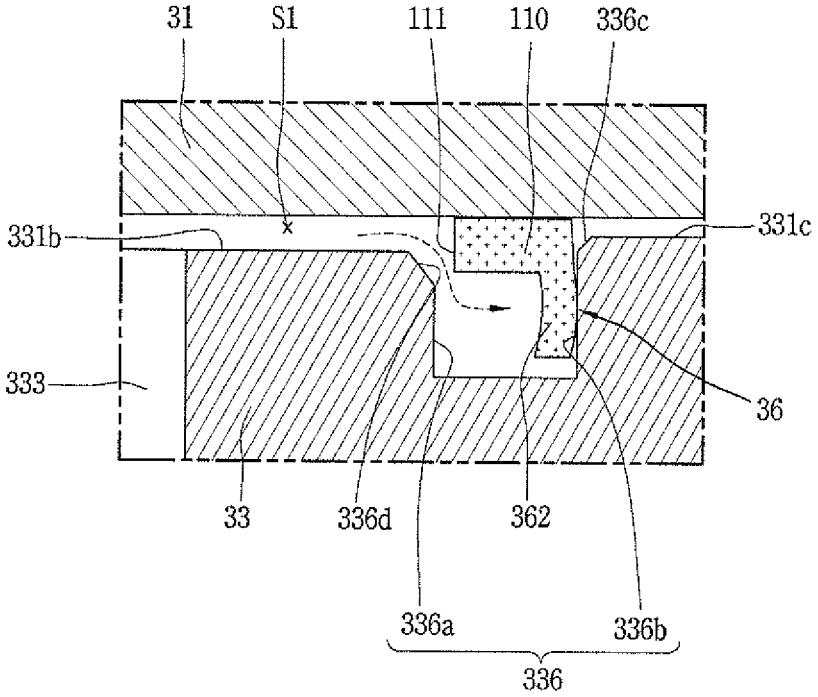
Figure 13A:
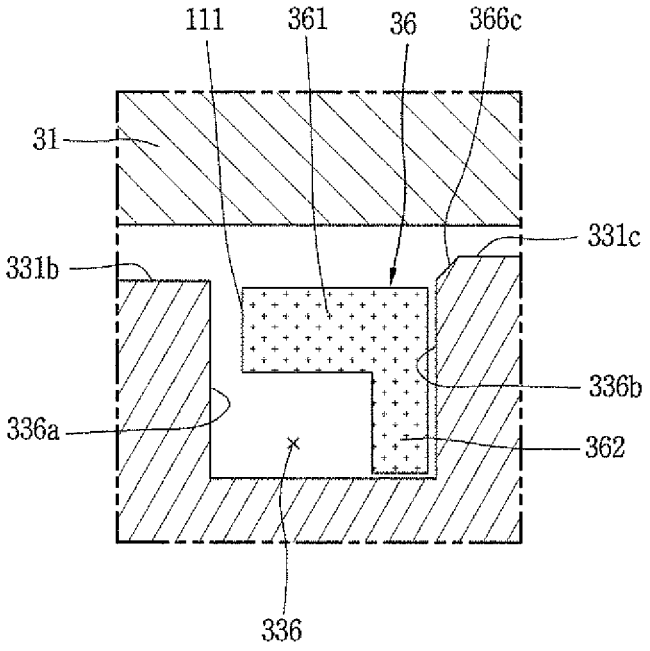
Figure 13B:
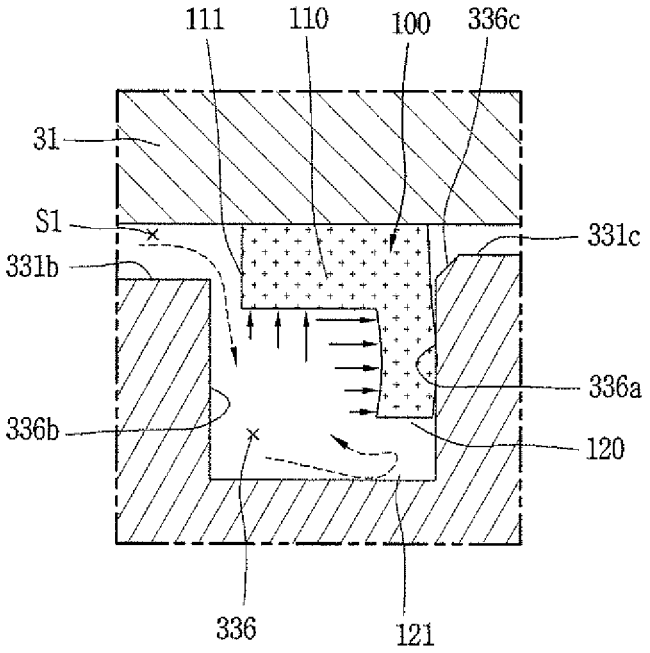
Figure 14:
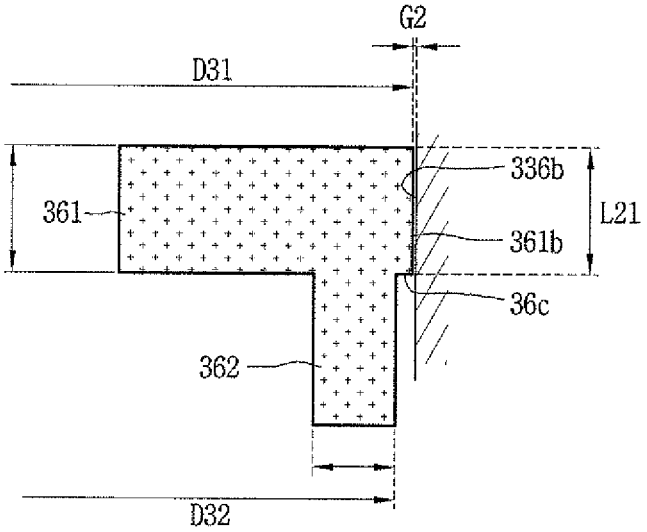
Figure 15:
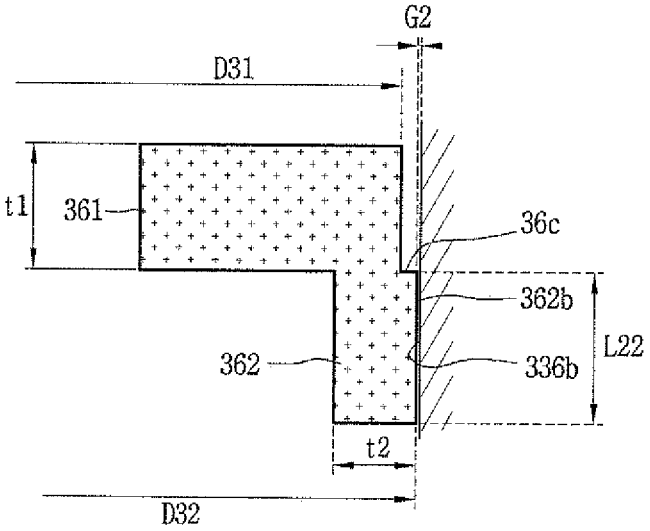
Figure 16:
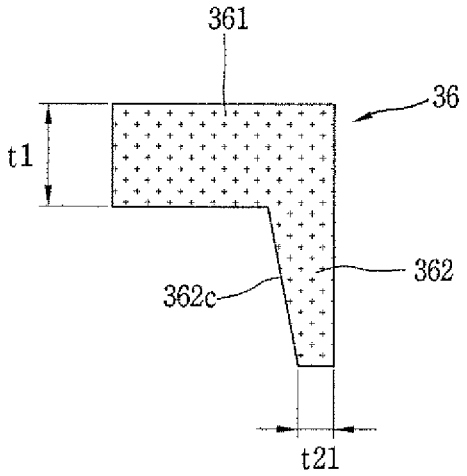
Figure 17:
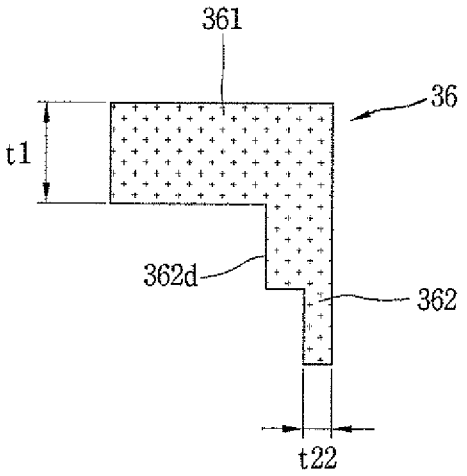
Figure 18:
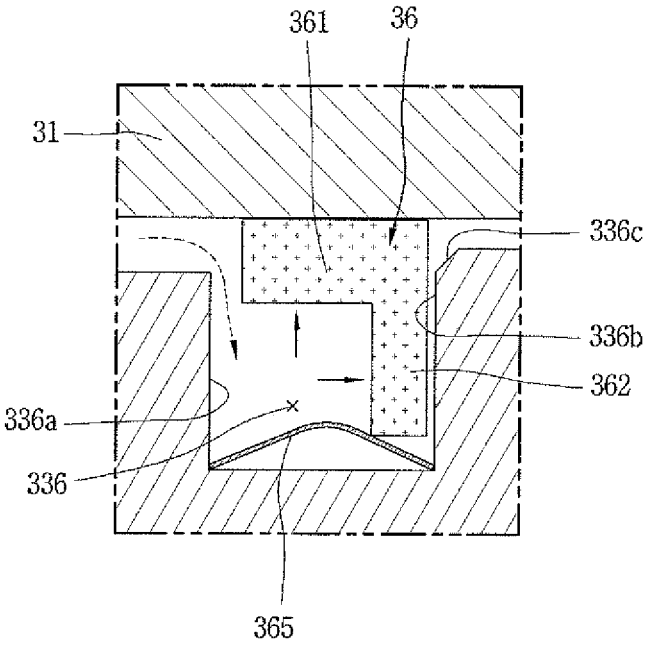
Figure 19:
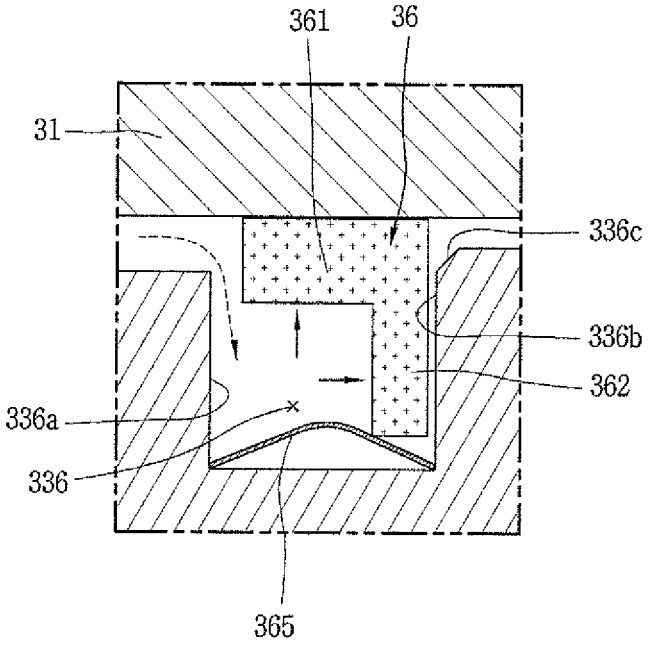

FIG. 11 is a longitudinal sectional view showing an embodiment of a fitting prevention unit of a sealing member according to this embodiment;

FIG. 12 is a longitudinal sectional view showing an embodiment of an oil guiding unit of a sealing member insertion groove according to this embodiment;

FIGS. 13A and 13B are longitudinal sectional views showing a stopped state and a driving state of a compressor with respect to a sealing member according to this embodiment;

FIGS. 14 and 15 are schematic views showing other embodiments of a sealing member according to this embodiment;

FIGS. 16 and 17 are longitudinal sectional views showing other embodiments of a sealing member according to the present invention; and FIG. 18 is a longitudinal sectional view showing another embodiment to upward-move a sealing member in a scroll compressor according to the present invention.

DETAILED DESCRIPTION

Description will now be given in detail of a scroll compressor according to exemplary embodiment disclosed herein, with reference to the accompanying drawings.

In general, a scroll compressor may be divided into a low pressure type in which a suction pipe communicates with an internal space of a casing constituting a low pressure portion and a high pressure type in which a suction pipe directly communicates with a compression chamber. Accordingly, in the low pressure type, a drive unit is provided in a suction space which is the low pressure portion, whereas in the high pressure type, a drive unit is provided in a discharge space which is the high pressure portion. Such a scroll compressor may be divided into an upper compression type and a lower compression type according to positions of the drive unit and the compression unit. A compressor in which the compression unit is located above the drive unit is referred to as an upper compression type, and a compressor in which the compression unit is located below the drive unit is referred to as a lower compression type. Hereinafter, a scroll compressor of a type in which a rotating shaft overlaps an orbiting wrap on the same plane will be exemplarily described as a lower compression type scroll compressor. This type of scroll compressor is known to be suitable for application to a refrigeration cycle under high temperature and high compression ratio conditions.

Figure 1:
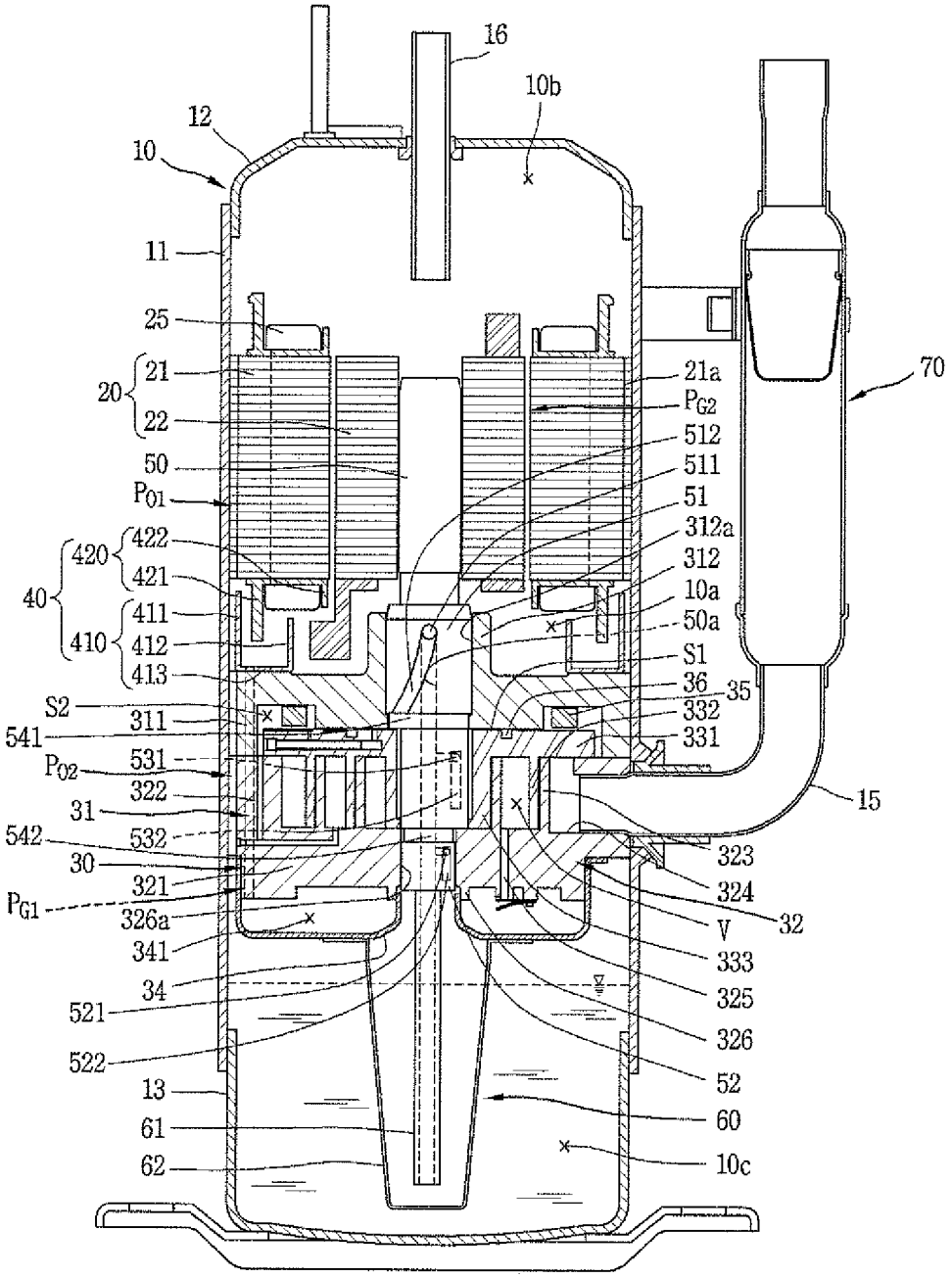
Figure 2:
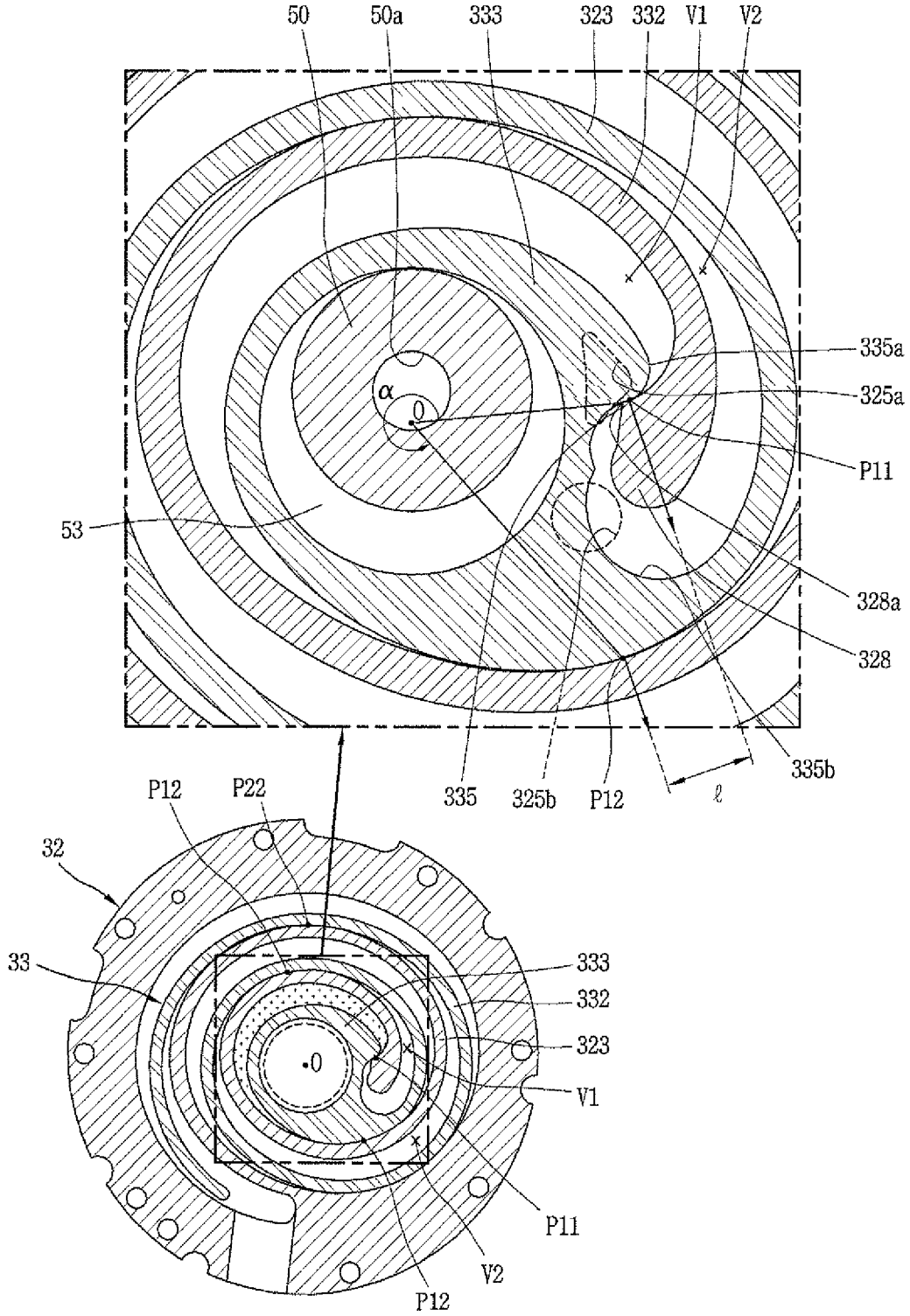
Figure 3:
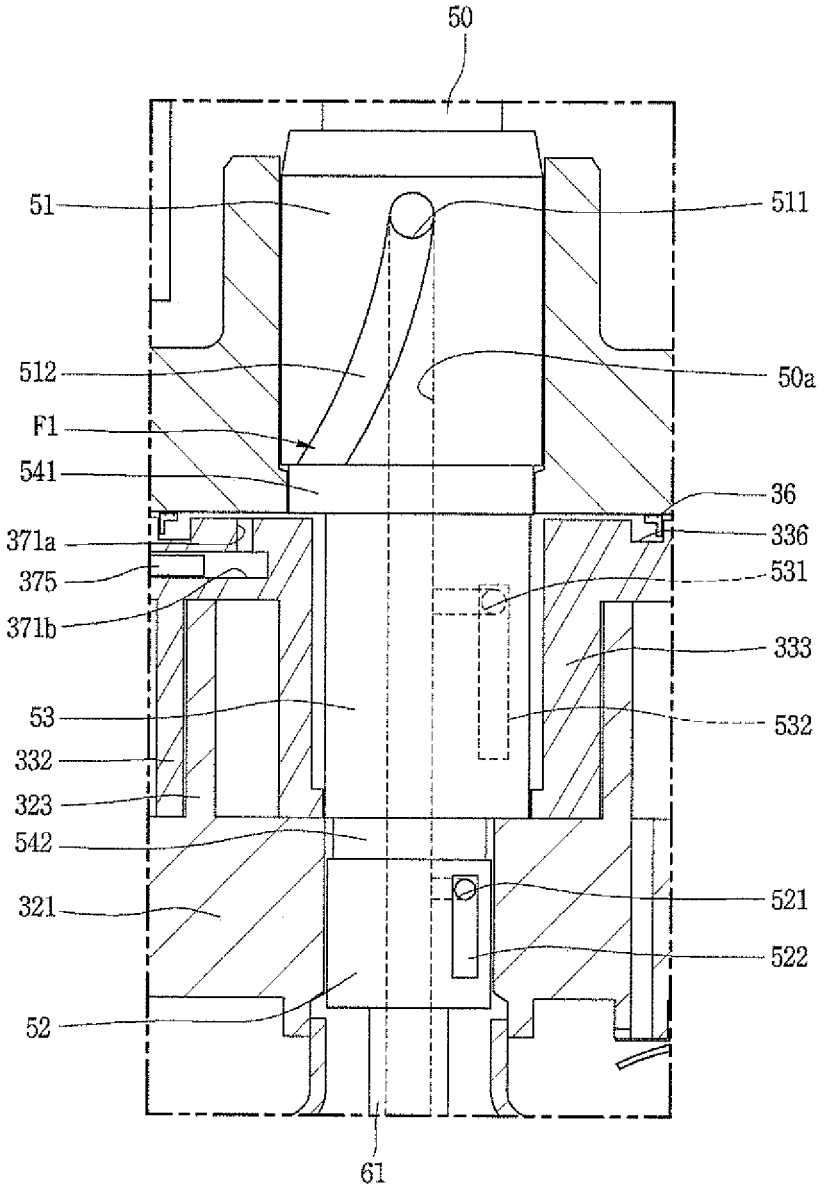
Figure 4:
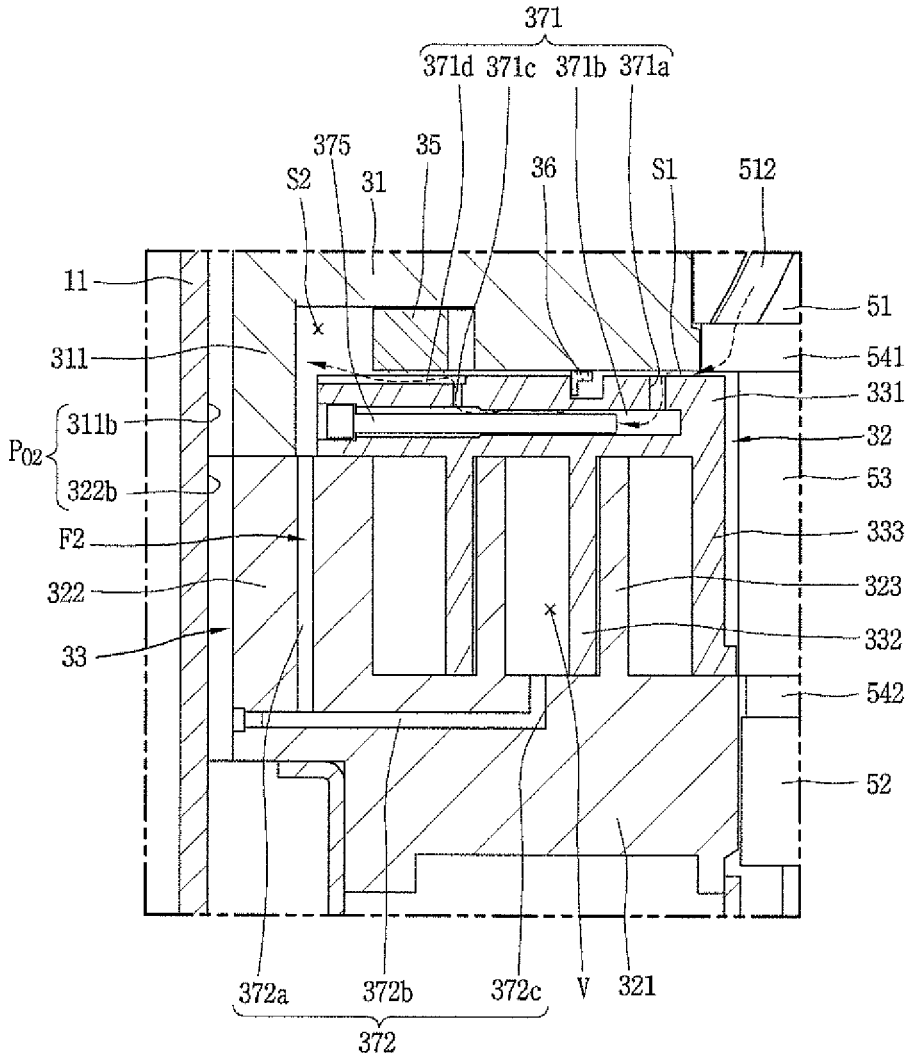

FIG. 1 is a longitudinal sectional view of a lower compression-type scroll compressor in accordance with the present invention, FIG. 2 is a horizontal sectional view of a compression unit of FIG. 1, FIG. 3 is a front view illustrating a part of a rotating shaft for illustrating a sliding portion in FIG. 1, and FIG. 4 is a longitudinal sectional view illustrating an oil supply passage (oil feeding path) between a back pressure chamber and a compression chamber in FIG. 1.

Referring to FIG. 1, a lower compression type scroll compressor according to the present embodiment may be provided with a motor unit 20 having a driving motor within a casing 10 to generate a rotational force, and a compression unit 30 located below the motor unit 20 and having a predetermined space (hereinafter, referred to as an intermediate space) 10*a* to compress refrigerant by receiving the rotational force of the motor unit 20.

The casing 10 may include a cylindrical shell 11 forming a hermetic container, an upper shell 12 forming the hermetic container by covering an upper portion of the cylindrical shell 11, and a lower shell 13 forming the hermetic container by covering a lower portion of the cylindrical shell 11 and simultaneously forming an oil storage space 10*c*.

A refrigerant suction pipe 15 may directly communicate with a suction chamber of the compression unit 30 through a lateral surface of the cylindrical shell 11, and a refrigerant discharge pipe 16 communicating with an upper space 10*b* of the casing 10 may be provided through a top of the upper shell 12. The refrigerant discharge pipe 16 may correspond to a path through which compressed refrigerant discharged from the compression unit 30 to the upper space 10*b* of the casing 10 is discharged to outside. The refrigerant discharge pipe 16 may be inserted up to a middle of the upper space 10*b* of the casing 10 to allow the upper space 10*b* to form a kind of oil separation space. Furthermore, according to circumstances, an oil separator (not shown) for separating oil mixed with refrigerant may be connected to the refrigerant suction pipe 15 within the casing 10 including the upper space 10*b* or within the upper space 10*b*.

The motor unit 20 may include a stator 21 and a rotor 22 rotating within the stator 21. The stator 21 is provided with teeth and slots forming a plurality of coil winding portions (not shown) on an inner circumferential surface thereof along a circumferential direction, such that a coil 25 is wound therearound. A second refrigerant passage PG2 is formed by combining a gap between the inner circumferential surface of the stator 21 and an outer circumferential surface of the rotor 22 with the coil winding portions. As a result, refrigerant discharged into the intermediate space 10*a* between the motor unit 20 and the compression unit 30 through a first refrigerant passage PG1 which will be described later flows to the upper space 10*b* formed above the motor unit 20 through the second refrigerant passage PG2 formed in the motor unit 20.

Furthermore, a plurality of D-cut faces 21*a* are formed on an outer circumferential surface of the stator 21 along the circumferential direction. The plurality of D-cut face 21*a* may form a first oil passage PO1 together with an inner circumferential surface of the cylindrical shell 11 to allow a flow of oil. As a result, oil separated from refrigerant in the upper space 10*b* flows to the lower space 10*c* through the first oil passage PO1 and a second oil passage PO2 which will be described later.

A frame 31 forming the compression unit 30 may be fixedly coupled to an inner circumferential surface of the casing 10 with a predetermined interval below the stator 21. An outer circumferential surface of the frame 31 may be shrink-fitted to or fixedly welded on an inner circumferential surface of the cylindrical shell 11.

Furthermore, a frame sidewall portion (first sidewall portion) 311 in an annular shape is formed at an edge of the frame 31, and a plurality of communication grooves 311*b* are formed on an outer circumferential surface of the first sidewall portion 311 along a circumferential direction. The communication grooves 311*b* form a second oil passage PO2 together with a communication groove 322*b* of the first scroll 32 which will be described later.

In addition, a first bearing 312 for supporting a main bearing 51 of a rotating shaft 50 which will be described later is formed in a center of the frame 31, and a first bearing hole 312*a* may be formed through the first bearing 312 in an axial direction such that the main bearing 51 of the rotating shaft 50 is rotatably inserted and supported in a radial direction.

Furthermore, a fixed scroll (hereinafter, referred to as a first scroll) 32 may be provided on a lower surface of the frame 31 with interposing therebetween an orbiting scroll (hereinafter, referred to as a second scroll) 33 which is eccentrically connected to the rotating shaft 50. The first scroll 32 may be fixedly coupled to the frame 31, but may also be movably coupled to the frame 31 in the axial direction.

On the other hand, the first scroll 32 may be provided with a fixed disk portion (hereinafter, referred to as a first disk portion 321) formed in a substantially disk shape, and a scroll sidewall portion (hereinafter, referred to as a second sidewall portion) 322 formed at an edge of the first disk portion 321 and coupled to a lower edge of the frame 31.

A suction port 324 through which the refrigerant suction pipe 15 and a suction chamber communicate with each other may be formed through one side (or portion) of the second sidewall portion 322, and a discharge port 325 which communicates with a discharge chamber and through which compressed refrigerant is discharged may be formed through a central portion of the first disk portion 321. The discharge port 325 may be provided with a first discharge port 325*a* and a second discharge port 325*b* to independently communicate with a first compression chamber V1 and a second compression chamber V2 to be explained later. These discharge ports will be described in detail later.

In addition, the communication groove 322*b* is formed on an outer circumferential surface of the second sidewall portion 322, and forms a second oil passage PO2 for guiding collected oil to the lower space 10*c*, together with the communication grooves 311*b* of the first sidewall portion 311.

Furthermore, a discharge cover 34 for guiding refrigerant discharged from the compression chamber V to a refrigerant passage which will be described later may be coupled to a lower side of the first scroll 32. An inner space of the discharge cover 34 may receive the first discharge port 325*a* and the second discharge port 325*b* and simultaneously receive an inlet of the first refrigerant passage PG1 for guiding refrigerants discharged from the compression chamber V through the discharge ports 325*a* and 325*b* to the upper space 10*b* of the casing 10, more particularly, a space between the motor unit 20 and the compression unit 30.

Here, the first refrigerant passage PG1 may be formed sequentially through the second sidewall portion 322 of the fixed scroll 32 and the first sidewall portion 311 of the frame 31 from an inside of a passage separation unit 40, namely, from a side of the rotating shaft 50, which is located at an inside based on the passage separation unit 40. As a result, the second oil passage PO2 is formed at an outside of the passage separation unit 40 to communicate with the first oil passage PO1.

Furthermore, a fixed wrap (hereinafter, referred to as a first wrap) 323 forming the compression chamber V in engagement with an orbiting wrap (hereinafter, referred to as a second wrap) 33 which will be described later may be formed on an upper surface of the first disk portion 321. The first wrap 323 will be described later together with the second wrap 332.

In addition, a second bearing 326 for supporting a sub-bearing 52 of the rotating shaft 50 which will be described later may be formed in the center of the first disk portion 321, and a second bearing hole 326*a* may be formed through the second bearing 326 in an axial direction to support the sub-bearing 52 in a radial direction.

The first disk portion 321 is provided with a bypass hole 381 for bypassing a part of refrigerant to be compressed in advance, and a bypass valve 385 is installed at an outlet end of the bypass hole 381. The bypass hole 381 may be provided by one or more in number at an appropriate position along a moving direction of the compression chamber V so as to be located between the suction chamber and the discharge chamber. And the bypass hole 381 may be formed such that its interval may become narrow towards a discharge side from the second compression chamber V2 having a large compression gradient.

On the other hand, the second scroll 33 may be provided with an orbiting disk portion (hereinafter, referred to as second disk portion) 331 formed in a substantially disk shape. A second wrap 332 forming a compression chamber in engagement with the first wrap 331 may be formed on a lower surface of the second disk portion 331.

The second wrap 332 may be formed in an involute shape together with the first wrap 323, but may also be formed in various other shapes. For example, as illustrated in FIG. 2, the second wrap 332 may have a shape in which a plurality of arcs having different diameters and origins are connected, and the outermost curve may be formed in a substantially elliptical shape having a major axis and a minor axis. The first wrap 323 may be formed in a similar manner.

A rotating shaft coupling portion 333 which forms an inner end portion of the second wrap 332 and to which an eccentric portion 53 of the rotating shaft 50 to be described later is rotatably inserted may be formed through a central portion of the second disk portion 331 in an axial direction.

An outer circumferential portion of the rotating shaft coupling portion 333 is connected to the second wrap 332 to form the compression chamber V together with the first wrap 322 during a compression process.

Furthermore, the rotating shaft coupling portion 333 may be formed at a height overlapping with the second wrap 332 on the same plane, and thus the eccentric portion 53 of the rotating shaft 50 may be formed at a height overlapping with the second wraps 332 on the same plane. Accordingly, a repulsive force and a compressive force of refrigerant offset each other while being applied to the same plane based on the second disk portion, thereby preventing an inclination of the second scroll 33 due to an action of the compressive force and repulsive force.

In addition, the rotating shaft coupling portion 333 is provided with a concave portion 335 formed on an outer circumferential portion facing an inner end portion of the first wrap 323 and engaged with a protruding portion 328 of the first wrap 323 which will be described later. At one side of the concave portion 335 is formed an increasing portion 335*a* having a thickness increasing from an inner circumferential portion to an outer circumferential portion of the rotating shaft coupling portion 333 at an upstream side along the forming direction of the compression chamber V. Accordingly, a compression path of the first compression chamber V1 immediately before discharge may extend and thus a compression ratio of the first compression chamber V1 may be increased to be similar to a compression ratio of the second compression chamber V2. The first compression chamber V1 is a compression chamber formed between an inner surface of the first wrap 323 and an outer surface of the second wrap 332, and will be described later separately from the second compression chamber V2.

At another side of the concave portion 335 is formed an arcuate compression surface 335*b* having an arcuate shape. A diameter of the arcuate compression surface 335*b* is decided by a thickness of the inner end portion of the first wrap 323 (i.e., a thickness of the discharge end) and an orbiting radial of the second wrap 332. When the thickness of the inner end portion of the first wrap 323 increases, a diameter of the arcuate compression surface 335*b* increases. As a result, a thickness of the second wrap around the arcuate compression surface 335*b* may increase to ensure durability, and the compression path may extend to increase the compression ratio of the second compression chamber V2 to that extent.

In addition, the protruding portion 328 protruding toward the outer circumferential portion of the rotating shaft coupling portion 333 may be formed adjacent to an inner end portion (a suction end or starting end) of the first wrap 323 corresponding to the rotating shaft coupling portion 333. The protruding portion 328 may be provided with a contact portion 328*a* protruding therefrom and engaged with the concave portion 335. In other words, the inner end portion of the first wrap 323 may be formed to have a larger thickness than other portions. As a result, wrap strength at the inner end portion of the first wrap 323, which is subjected to the highest compressive force on the first wrap 323, may increase so as to enhance durability.

On the other hand, the compression chamber V may be formed between the first disk portion 321 and the first wrap 323, and between the second wrap 332 and the second disk portion 331, and have a suction chamber, an intermediate pressure chamber, and a discharge chamber which are formed sequentially along a proceeding direction of the wrap.

As illustrated in FIG. 2, the compression chamber V may include the first compression chamber V1 formed between an inner surface of the first wrap 323 and an outer surface of the second wrap 332, and the second compression chamber V2 formed between an outer surface of the first wrap 323 and an inner surface of the second wrap 332.

In other words, the first compression chamber V1 includes a compression chamber formed between two contact points P11 and P12 generated in response to the inner surface of the first wrap 323 being brought into contact with the outer surface of the second wrap 332, and the second compression chamber V2 includes a compression chamber formed between two contact points P21 and P22 generated in response to the outer surface of the first wrap 323 being brought into contact with the inner surface of the second wrap 332.

Here, when a large angle of angles formed between two lines, which connect a center of the eccentric portion, namely, a center O of the rotation shaft coupling portion to the two contact points P11 and P12, respectively, is defined as a within the first compression chamber V2 just before discharge, the angle $\alpha$ at least just before the discharge is larger than 360° (i.e., $\alpha<360°$), and a distance l between normal vectors at the two contact points (P11, P12) also has a value greater than zero.

As a result, the first compression chamber immediately before the discharge may have a smaller volume as compared to a case where a fixed wrap and an orbiting wrap have a shape of an involute curve. Therefore, the compression ratios of the first and second compression chambers V1 and V2 can all be improved even without increasing the sizes of the first wrap 323 and the second wrap 332.

On the other hand, as described above, the second scroll 33 may be orbitally provided between the frame 31 and the fixed scroll 32. An Oldham ring 35 for preventing rotation of the second scroll 33 may be provided between an upper surface of the second scroll 33 and a lower surface of the frame 31, and a sealing member 36 for forming a back pressure chamber S1 to be explained later may be provided at an inner side rather than the Oldham ring 35.

An intermediate pressure space is formed by an oil feeding hole 321*a* provided on the second scroll 32 at an outside of the sealing member 36. The intermediate pressure space communicates with an intermediate compression chamber V and thus is filled with refrigerant of intermediate pressure, so as to serve as a back pressure chamber. Therefore, a back pressure chamber formed at an inside with respect to the sealing member 36 may be referred to as a first back pressure chamber S1, and an intermediate pressure space formed at an outside may be referred to as a second back pressure chamber S2. As a result, the back pressure chamber S1 is a space formed by a lower surface of the frame 31 and an upper surface of the second scroll 33 based on the sealing member 36, and will be described later again along with the sealing member.

On the other hand, the passage separation unit 40 is provided in the intermediate space 10*a*, which is a via space formed between a lower surface of the motor unit 20 and an upper surface of the compression unit 30, to play the role of preventing refrigerant discharged from the compression unit 30 from interfering with oil flowing from the upper space 10*b* of the motor unit 20 which is an oil separation space to the lower space 10*c* of the compression unit 30 which is an oil storage space.

To this end, the passage separation unit 40 according to this embodiment includes a passage guide for dividing the first space 10*a* into a space through which refrigerant flows (hereinafter, referred to as a refrigerant flow space) and a space through which oil flows (hereinafter, referred to as an oil flow space). The first space 10*a* may be divided into the refrigerant flow space and the oil flow space by only the passage guide, but according to circumstances, a plurality of passage guides may be combined to perform the role of the passage guide.

The passage separation unit 40 according to this embodiment includes a first passage guide 410 provided in the frame 31 and extending upward, and a second passage guide 420 provided in the stator 21 and extending downward. The first passage guide 410 and the second passage guide 420 may overlap each other in an axial direction to divide the intermediate space 10*a* into the refrigerant flow space and the oil flow space.

Here, the first passage guide 410 may be formed in an annular shape and fixedly coupled to the upper surface of the frame 31, and the second passage guide 420 may extend from an insulator which is inserted into the stator 21 and for insulating winding coils.

The first passage guide 410 may include a first annular wall portion 411 extending upward from an outer side, a second annular wall portion 412 extending upward from an inner side, and an annular surface portion 413 extending in a radial direction to connect the first annular wall portion 411 and the second annular wall portion 412. The first annular wall portion 411 may be formed higher than the second annular wall portion 412, and the annular surface portion 413 may be provided with a refrigerant through hole formed from the compression unit 30 to the intermediate space 10*a* in a communicating manner.

Furthermore, a balance weight 26 is located at an inside of the second annular wall portion 412, namely, in a rotational shaft direction, and coupled to the rotor 22 or the rotating shaft 50 to rotate. At this time, refrigerant may be stirred while the balance weight 26 rotates, but the second annular wall portion 412 may prevent the refrigerant from moving toward the balance weight 26 to suppress the refrigerant from being stirred by the balance weight 26.

The second flow guide 420 may include a first extending portion 421 extending downward from the outside of the insulator and a second extending portion 422 extending downward from the inside of the insulator. The first extending portion 421 is formed to overlap the first annular wall portion 411 in the axial direction to play a role of separating the refrigerant flow space from the oil flow space. The second extending portion 422 may not be formed as necessary. Even when it is formed, the second extending portion 422 is preferably formed not to overlap the second annular wall portion 412 in the axial direction, or formed at a sufficient distance from the second annular wall portion 412 in a radial direction, such that the refrigerant can sufficiently flow even if it overlaps the second annular wall portion 412.

On the other hand, an upper portion of the rotating shaft 50 is press-fitted into the center of the rotor 22 while a lower portion thereof is coupled to the compression unit 30 to be supported in the radial direction. Accordingly, the rotating shaft 50 transfers the rotational force of the motor unit 20 to the orbiting scroll 33 of the compression unit 30. Then, the second scroll 33 eccentrically coupled to the rotating shaft 50 performs an orbiting motion with respect to the first scroll 32.

A main bearing (hereinafter, referred to as a first bearing) 51 may be formed at a lower portion of the rotating shaft 50 to be inserted into the first bearing hole 312*a* of the frame 31 and supported in a radial direction, and a sub-bearing (hereinafter, referred to as a second bearing) 52 may be formed at a lower side of the first bearing 51 to be inserted into the second bearing hole 326*a* of the first scroll 32 and supported in a radial direction. Furthermore, the eccentric portion 53 may be provided between the first bearing 51 and the second bearing 52 in a manner of being inserted into the rotating shaft coupling portion 333.

The first bearing 51 and the second bearing 52 may be coaxially formed to have the same axial center, and the eccentric portion 53 may be eccentrically formed in the radial direction with respect to the first bearing 51 or the second bearing 52. The second bearing 52 may be eccentrically formed with respect to the first bearing 51.

The eccentric portion 53 should be formed in such a manner that its outer diameter is smaller than an outer diameter of the first bearing 51 and larger than an outer diameter of the second bearing 52 to be advantageous in coupling the rotating shaft 50 through the respective bearing holes 312*a* and 326*a* and the rotating shaft coupling portion 333. However, in case where the eccentric portion 53 is formed using a separate bearing without being integrally formed with the rotating shaft 50, the rotating shaft 50 may be inserted even when the outer diameter of the second bearing 52 is not smaller than the outer diameter of the eccentric portion 53.

Furthermore, an oil supply passage 50*a* for supplying oil to each bearing and the eccentric portion may be formed within the rotating shaft 50 along the axial direction. As the compression unit 30 is located below the motor unit 20, the oil supply passage 50*a* may be formed from a lower end of the rotating shaft 50 to approximately a lower end or a middle height of the stator 21 or a position higher than an upper end of the first bearing 31 in a grooving manner. Of course, according to circumstance, the oil supply passage 50*a* may also be formed by penetrating through the rotating shaft 50 in an axial direction.

In addition, an oil feeder 60 for pumping up oil filled in the lower space 10*c* may be coupled to the lower end of the rotating shaft 50, namely, a lower end of the second bearing 52. The oil feeder 60 may include an oil supply pipe 61 inserted into the oil supply passage 50*a* of the rotating shaft 50, and a blocking member 62 for blocking an introduction of foreign materials by receiving the oil supply pipe 61 therein. The oil supply pipe 61 may be located to be immersed in oil of the lower space 10*c* through the discharge cover 34.

On the other hand, as illustrated in FIG. 3, a sliding portion oil supply path F1 connected to the oil supply passage 50*a* to supply oil to each sliding portion is formed in each bearing 51 and 52 and the eccentric portion 53 of the rotating shaft 50.

The sliding portion oil supply path F1 may include a plurality of oil supply holes 511, 521 and 531 formed through the oil supply passage 50*a* toward an outer circumferential surface of the rotating shaft 50, and a plurality of oil supply grooves 512, 522 and 532 communicating with the oil supply holes 511, 521 and 531, respectively, to lubricate each bearing 51, 52 and the eccentric portion 53.

For example, the first oil supply hole 511 and the first oil supply groove 512 are formed in the first bearing 51, and the second oil supply hole 521 and the second oil supply groove 522 are formed in the second bearing 52. Also, the third oil supply hole 531 and the third oil supply groove 532 are formed in the eccentric portion 53. Each of the first oil supply groove 512, the second oil supply groove 522, and the third oil supply groove 532 is formed in a slot shape extending in an axial or inclined direction.

Furthermore, a first connection groove 541 and a second connection groove 541 each formed in an annular shape may be formed between the first bearing 51 and the eccentric portion 53 and between the eccentric portion 53 and the second bearing 52, respectively. The first connection groove 541 communicates with a lower end of the first oil supply groove 512 and the second oil supply groove 522 is connected with the second connection groove 542. Accordingly, a part of oil that lubricates the first bearing 51 through the first oil supply groove 512 flows down to be collected into the first connection groove 541, and then introduced into the first back pressure chamber s1, thereby forming back pressure of discharge pressure. And, oil that lubricates the second bearing 52 through the second oil supply groove 522 and oil that lubricates the eccentric portion 53 through the third oil supply groove 532 are collected into the second connection groove 542, and then introduced into the compression unit 30 through a space between a front end surface of the rotating shaft coupling portion 333 and the first disk portion 321.

In addition, a small amount of oil sucked up toward an upper end of the first bearing 51 flows out of a bearing surface from an upper end of the first bearing portion 312 of the frame 31 and flows down toward an upper surface 31*a* of the frame 31 along the first shaft bearing portion 312. Afterwards, the oil is collected into the lower space 10*c* through the oil passages PO1 and PO2 consecutively formed on an outer circumferential surface of the frame 31 (or a groove communicated from the upper surface to the outer circumferential surface) and an outer circumferential surface of the first scroll 32.

Moreover, oil discharged from the compression chamber V to the upper space 10*b* of the casing 10 together with refrigerant is separated from the refrigerant in the upper space 10*b* of the casing 10 and collected into the lower space 10*c* through the first oil passage PO1 formed on an outer circumferential surface of the motor unit 20 and the second oil passage PO2 formed on an outer circumferential surface of the compression unit 30. At this time, the passage separation unit 40 is provided between the motor unit 20 and the compression unit 30. Accordingly, oil which is separated from refrigerant in the upper space 10*b* may flow toward the lower space 10*c* along the passages PO1 and PO2, without being re-mixed with refrigerant which is discharged from the compression unit 20 and flows toward the upper space 10*b*, and the refrigerant moving toward the upper surface 10*b* may flow toward the upper pace 10*b* along the passages PG1 and PG2.

On the other hand, the second scroll 33 is provided with a compression chamber oil supply path F2 for supplying oil sucked up through the oil supply passage 50*a* into the compression chamber V. The compression chamber oil supply path F2 is connected to the sliding portion oil supply path F1.

The compression chamber oil supply path F2 may include a first oil supply path 371 communicating the oil supply passage 50*a* with the second back pressure chamber S2 forming an intermediate pressure space, and a second oil supply path 372 communicating the second back pressure chamber S2 with the intermediate pressure chamber of the compression chamber V.

Of course, the compression chamber oil supply path may also be formed to communicate directly with the intermediate pressure chamber from the oil supply passage 50*a* without passing through the second back pressure chamber S2. In this case, however, a refrigerant passage for communicating the second back pressure chamber S2 with the intermediate pressure chamber V should be separately provided, and an oil passage for supplying oil to the Oldham ring 35 located in the second back pressure chamber S2 should be separately provided. This causes an increase in a number of passages and complicates processing. Therefore, even in order to reduce the number of passages or paths by unifying the refrigerant passage and the oil passage, as described in this embodiment, it may be preferable to communicate the oil supply passage 50*a* with the second back pressure chamber S2 and the second back pressure chamber S2 with the intermediate pressure chamber V.

To this end, the first oil supply path 371 is provided with a first orbiting passage portion 371*a* formed from an upper surface down to a middle of the second disk portion 331 in a thickness direction, a second orbiting passage portion 371*b* formed from the first orbiting passage portion 371*a* toward an outer circumferential surface of the second disk portion 331, and a third orbiting passage portion 371*c* formed through the upper surface of the second disk portion 331 from the second orbiting passage portion 371*b*.

Furthermore, the first orbiting passage portion 371*a* is located at a position belonging to the first back pressure chamber S1, and the third orbiting passage portion 371*c* is located at a position belonging to the second back pressure chamber S2. Furthermore, a pressure reducing rod 375 is inserted into the second orbiting passage portion 371*b* to reduce pressure of oil which flows from the first back pressure chamber S1 to the second back pressure chamber S2 through the first oil supply passage 371. Accordingly, a sectional area of the second orbiting passage portion 371*b* excluding the pressure reducing rod 375 is formed to be smaller than that of the first orbiting passage portion 371*a* or the third orbiting passage portion 371*c*.

Here, in case where an end portion of the third orbiting passage portion 371*c* is formed to be located at an inside of the Oldham ring 35, namely, between the Oldham ring 35 and the sealing member 36, oil flowing through the first oil supply passage 371 may be blocked by the Oldham ring 35 and thus may not smoothly flow to the second back pressure chamber S2. Therefore, in this case, a fourth orbiting passage portion 371*d* may be formed from the end portion of the third orbiting passage portion 371*c* toward an outer circumferential surface of the second disk portion 331. The fourth orbiting passage portion 371*d* may be formed as a groove on an upper surface of the second disk portion 331 as illustrated in FIG. 4, or may be formed as a hole within the second disk portion 331.

The second oil supply passage 372 is provided with a first fixed passage portion 372*a* on an upper surface of the second sidewall portion 322 in a thickness direction, a second fixed passage portion 372*b* formed from the first fixed passage portion 372*a* in a radial direction, and a third fixed passage portion 372*c* communicating the second fixed passage portion 372*b* with the intermediate pressure chamber V.

In the drawings, an unexplained reference numeral 70 denotes an accumulator.

A lower compression type scroll compressor according to the present embodiment operates as follows.

That is, when power is applied to the motor unit 20, rotational force is generated and the rotor 21 and the rotating shaft 50 rotate by the rotational force. As the rotating shaft 50 rotates, the orbiting scroll 33 eccentrically coupled to the rotating shaft 50 performs an orbiting motion by the Oldham ring 35.

Then, refrigerant supplied from an outside of the casing 10 through the refrigerant suction pipe 15 is introduced into the compression chamber V, and compressed as a volume of the compression chamber V is reduced by the orbiting motion of the orbiting scroll 33. The refrigerant is then discharged into an inner space of the discharge cover 34 through the first discharge port 325*a* and the second discharge port 325*b*.

Then, noise is reduced from the refrigerant discharged into the inner space of the discharge cover 34 while the refrigerant circulates within the inner space of the discharge cover 34. The noise-reduced refrigerant flows to a space between the frame 31 and the stator 21, and then is introduced into an upper space of the motor unit 20 through a gap between the stator 21 and the rotor 22.

Oil is separated from the refrigerant in the upper space of the motor unit 20. Accordingly, the refrigerant is discharge out of the casing 10 through the refrigerant discharge pipe 16, while the oil is collected back into the lower space 10*c* as the oil storage space of the casing 10 through a passage between the inner circumferential surface of the casing 10 and the stator 21 and a passage between the inner circumferential surface and the outer circumferential surface of the compression unit 30. This series of processes is repeated.

In this instance, the oil in the lower space 10*c* is sucked up through the oil supply passage 50*a* of the rotating shaft 50, so as to lubricate the first bearing 51, the second bearing 52, and the eccentric portion 53 through the oil supply holes 511, 521 and 531 and the oil supply grooves 512, 522 and 532, respectively.

Among others, oil that lubricates the first bearing 51 through the first oil supply hole 511 and the first oil supply groove 512 is collected into the first connection groove 51 between the first bearing 51 and the eccentric portion 53, and then introduced into the first back pressure chamber S1. This oil forms substantial discharge pressure, and thus the first back pressure chamber S1 is also filled with substantial discharge pressure. Therefore, a center portion of the second scroll 33 may be supported by the discharge pressure in an axial direction.

On the other hand, the oil in the first back pressure chamber S1 is moved to the second back pressure chamber S2 through the first oil supply passage 371 due to a pressure difference from the second back pressure chamber S2. At this time, the pressure reducing rod 375 provided in the second orbiting passage portion 371*b* forming the first oil supply passage 371 allows pressure of the oil flowing toward the second back pressure chamber S2 to be reduced to intermediate pressure.

In addition, the oil flowing to the second back pressure chamber (intermediate pressure space) S2 supports an edge portion of the second scroll 33 and simultaneously moves to the intermediate pressure chamber V through the second oil supply passage 372 due to a pressure difference from the intermediate pressure chamber V. However, when pressure of the intermediate pressure chamber V becomes higher than that of the second back pressure chamber S2 during the operation of the compressor, refrigerant flows from the intermediate pressure chamber V to the second back pressure chamber S2 through the second oil supply passage 372. In other words, the second oil supply passage 372 plays a role of a passage through which the refrigerant and the oil alternatively flow according to the pressure difference between the second back pressure chamber S2 and the intermediate pressure chamber V.

As aforementioned, the back pressure chamber is formed on a rear surface of the second scroll, i.e., an upper surface of the second scroll, in order to prevent the second scroll from being spaced apart from the first scroll by being pushed by a pressure of the compression chamber.

That is, as the sealing member is provided on a lower surface of the frame and on an upper surface of the second scroll, the first back pressure chamber is formed between the second scroll and the frame, and the second back pressure chamber is formed between the second scroll and the first scroll.

Accordingly, the sealing member preferably has an excellent sealing force between the frame and the second scroll, and an excellent abrasion resistance with consideration of a friction by an orbiting movement of the second scroll. Further, the sealing member is preferably formed of a material which can be rapidly upward-moved even at a low pressure since it performs a sealing function in an axial direction while being upward moved by a pressure, in an inserted state into a sealing member insertion groove of the second scroll.

Figure 5:
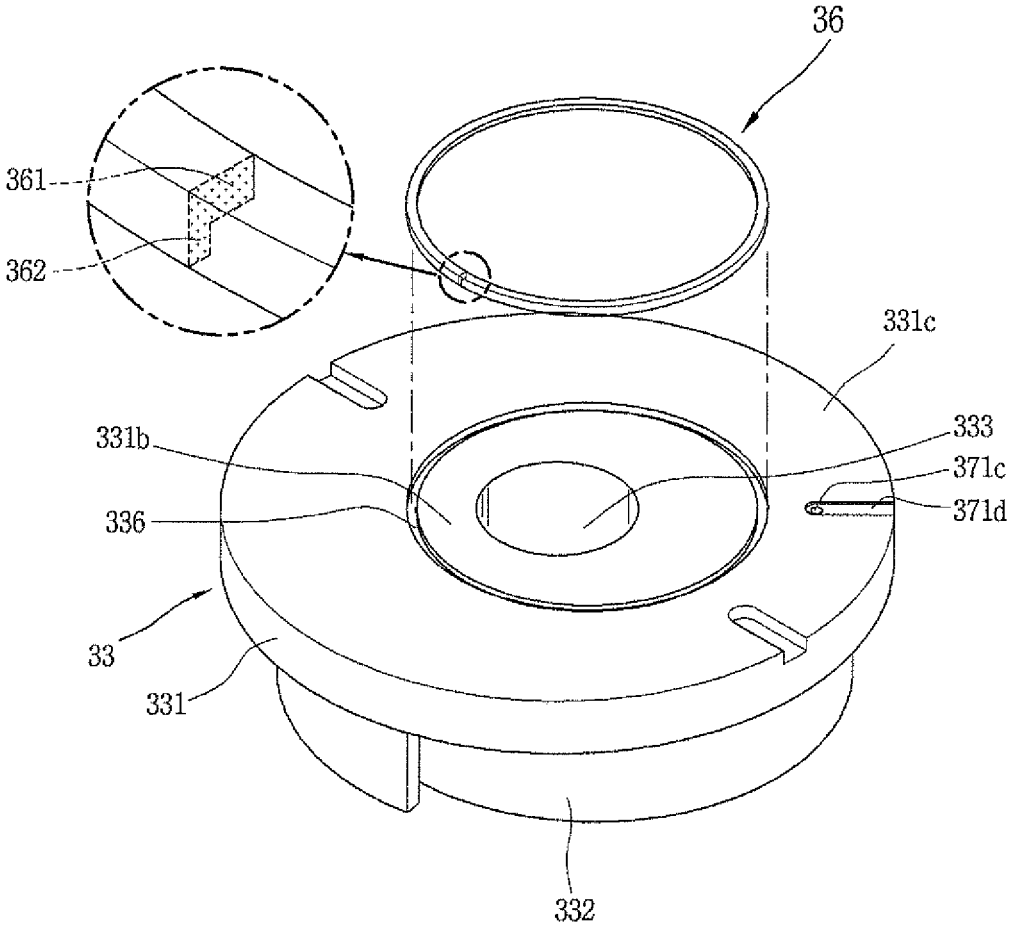
Figure 6:
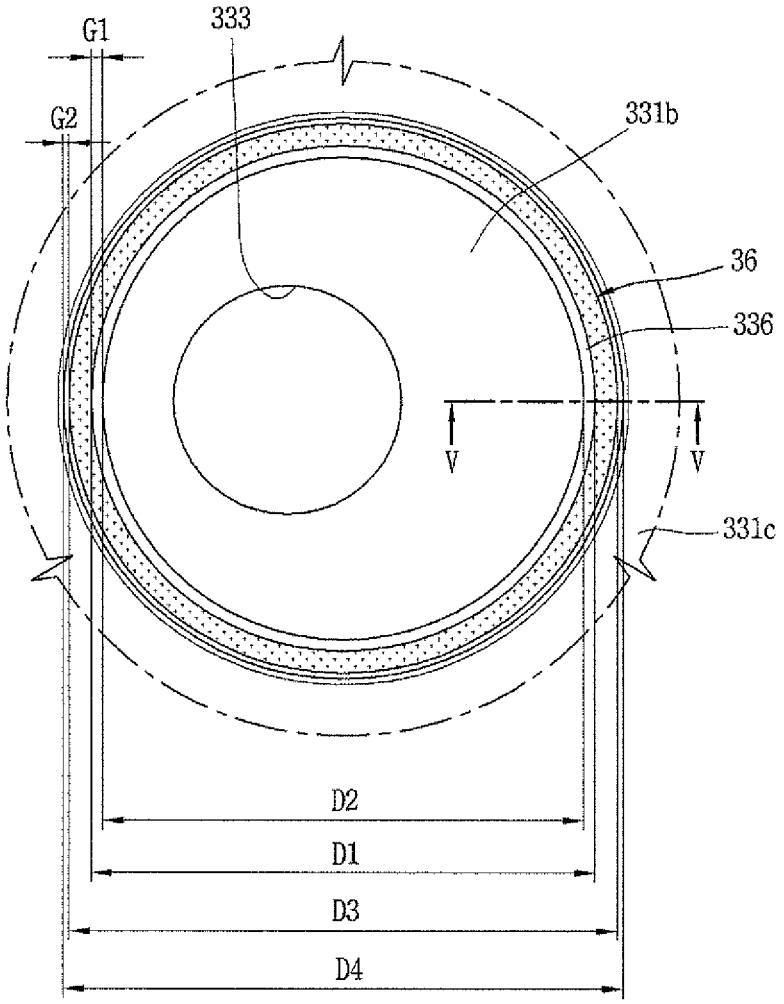
Figure 7:
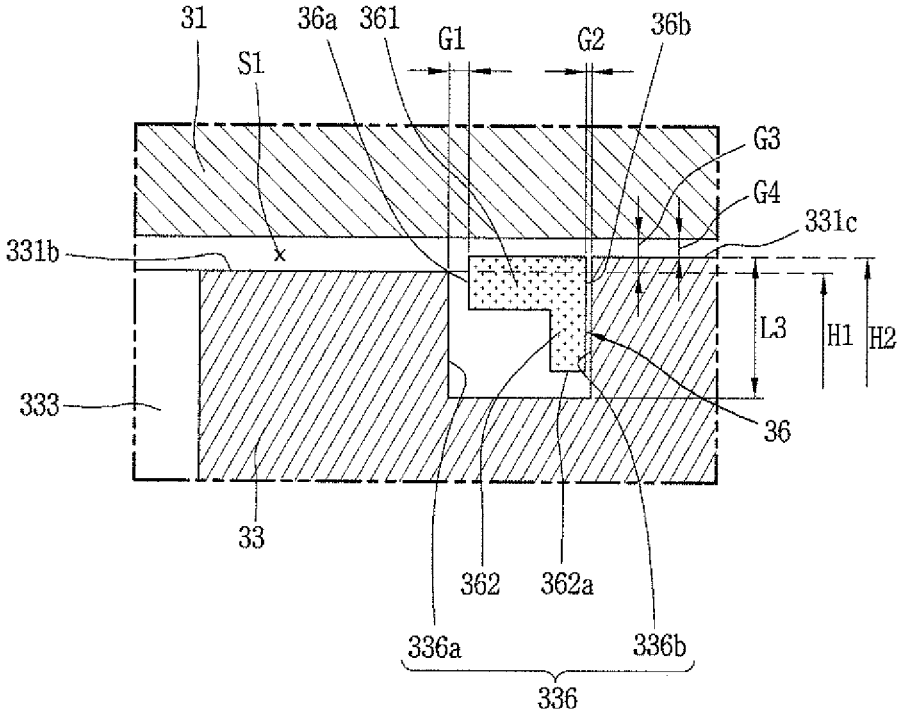

FIG. 5 is a disassembled perspective view of a sealing member according to this embodiment, FIG. 6 is a planar view showing an inserted state of the sealing member of FIG. 5 into a sealing member insertion groove, and FIG. 7 is a sectional view taken along line 'V-V' in FIG. 6.

As shown, the sealing member according to this embodiment 36 may be formed as a ring-shaped single body having no cut-out portion at a middle part thereof. The sealing member 36 is preferably formed of a material which is light and bendable by a pressure (e.g., teflon).

The sealing member 36 may include a first sealing portion 361 formed in a ring shape and forming an axial sealing surface as its upper surface contacts a lower surface of the frame 31, and a second sealing portion 362 downward-extended from an edge of a lower surface of the first sealing portion 361 in a ring shape, and forming a radial sealing surface as its outer circumferential surface contacts an outer side wall surface of a sealing member insertion groove 336.

As the first sealing portion 361 is formed to have a '-'-shaped sectional surface and the second sealing portion 362 is formed to have a '|'-shaped sectional surface at an edge of a lower surface of the first sealing portion 361, the sealing member 36 may be formed to entirely have a '¬'-shaped sectional surface. Accordingly, the first sealing portion 361 forms a free end at an inner circumferential surface 36*a* of the sealing member 36, i.e., an opposite end to an end from which the second sealing portion 362 is extended, whereas the second sealing portion 362 forms a free end at a lower end 362*a*, i.e., an opposite end to an end from which the first sealing portion 361 is extended. With such a configuration, as a peripheral portion of the lower end 362*a* forming a free end is outward bent by a pressure of the sealing member insertion groove 336, the second sealing portion 362 forms a radial sealing portion by being adhered to an outer side wall surface 336*b* of the sealing member insertion groove 336.

As shown in FIGS. 6 and 7, the sealing member 36 (precisely, the first sealing portion) may be formed such that its inner diameter (D1) may be larger than an inner diameter (D2) of the sealing member insertion groove 336 by a first gap (G1), and the sealing member 36 (precisely, the second sealing portion) may be formed such that its outer diameter (D3) may be smaller than an outer diameter (D4) of the sealing member insertion groove 336 by a second gap (G2).

With such a configuration, high-pressure fluid (refrigerant and oil) inside the sealing member 36 is introduced into the sealing member insertion groove 336 through the first gap (G1) formed between an inner side wall surface 336*a* of the sealing member insertion groove 336 and the inner circumferential surface 36*a* of the sealing member 36. And the sealing member 36 may be upward moved by a pressure of the fluid. Further, as the second gap (G2) is formed between the outer side wall surface 336*b* of the sealing member insertion groove 336 and an outer circumferential surface 36*b* of the sealing member 36, the sealing member 36 may be rapidly upward moved without interference with the sealing member insertion groove 336, through a non-contact or a slidable contact.

As the sealing member 36 according to this embodiment is formed in a ring-shape, a movement of the sealing member 36 in upper and lower directions is restricted by the size of the first gap (G1, G2), i.e., a gap between the inner circumferential surface 36*a* of the sealing member 36 and the inner side wall surface 336*a* of the sealing member insertion groove 336, and a gap between the outer circumferential surface 36*b* of the sealing member 36 and the outer side wall surface 336*b* of the sealing member insertion groove 336.

That is, if the first gap (G1) and the second gap (G2) are too narrow, the sealing member 36 may not be smoothly upward-moved because the inner circumferential surface 36*a* and the outer circumferential surface 36*b* of the sealing member 36 contact the sealing member insertion groove 336. Especially, as the second sealing portion 362 is outward widened by high-pressure oil introduced towards the first gap (G1), the sealing member 36 according to this embodiment is adhered to the outer side wall surface 336*b* of the sealing member insertion groove 336, thereby performing a sealing function. Accordingly, if the second gap (G2) is too narrow, the second sealing portion 362 is excessively adhered to the outer side wall surface 336*b* of the sealing member insertion groove 336. This may cause the sealing member 36 to be slowly upward-moved or to be abraded, or may cause the outer circumferential surface 36*b* of the sealing member 36 to be fitted into a space between the frame 31 and the second scroll 33. If the second gap (G2) is too large, refrigerant leakage may occur because a space between the outer circumferential surface 36*b* of the second sealing portion 362 and the outer side wall surface 336*b* of the sealing member insertion groove 336 does not have a sufficient sealing area.

Accordingly, in this embodiment, the first and second gaps (G1, G2) are formed to be within a predetermined range such that the sealing member 36 is rapidly and smoothly operated with effectively restricting refrigerant leakage.

For instance, as shown in FIGS. 6 and 7, the sealing member 36 according to this embodiment may be preferably formed such that the first gap (G1) may be larger than the second gap (G2), and the second gap (G2) may be 0.05~1.0% of the outer diameter (D3) of the sealing member 36.

Figure 8A:
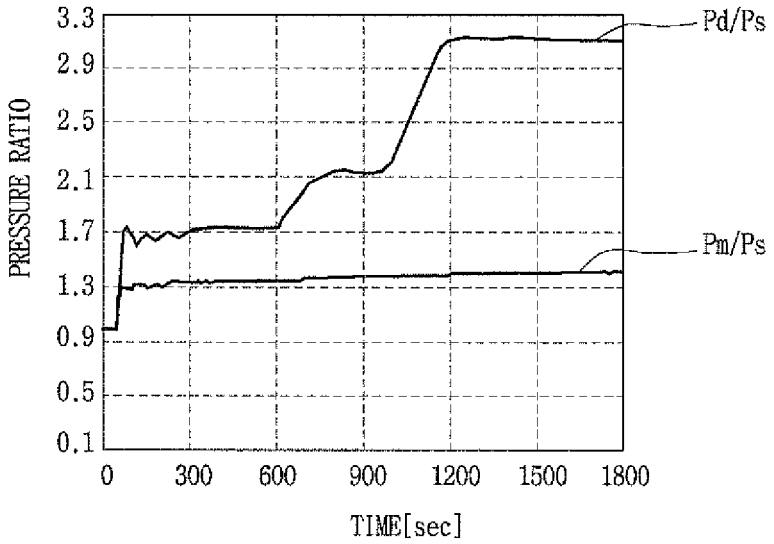
Figure 8B:
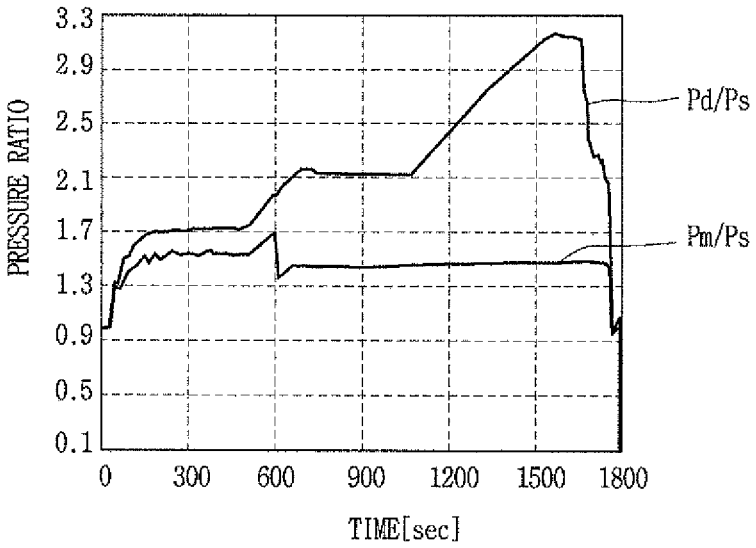
Figure 9:
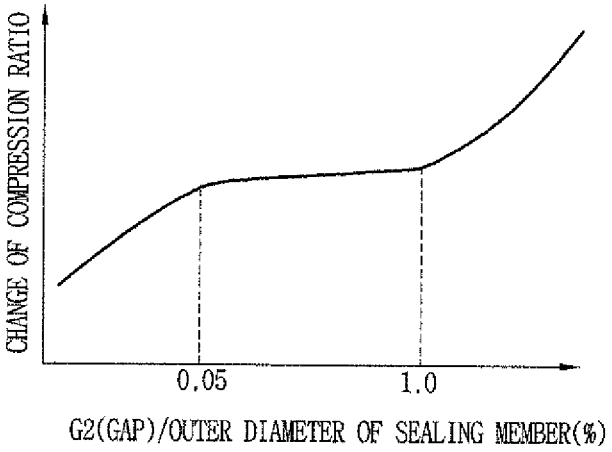

This may be seen from graphs shown in FIGS. 8A to 9.

FIG. 8A is a graph showing a compression ratio according to a driving time when a scroll compressor having a sealing member according to this embodiment is normally operated, and FIG. 8B is a graph showing a compression ratio according to a driving time when an operation of the scroll compressor having a sealing member according to this embodiment is delayed.

With regards to a pressure ratio of a discharge pressure with respect to a suction pressure (hereinafter, will be referred to as a discharge pressure ratio Pd/Ps), FIG. 8A shows that a discharge pressure ratio is increased up to a preset pressure as a predetermined time lapses when the sealing member 36 is normally operated, and the increased discharge pressure ratio is maintained. On the other hand, FIG. 8B shows that a discharge pressure ratio is increased up to a value near a preset pressure when the sealing member 36 is abnormally operated, and the increased discharge pressure ratio is drastically lowered without being maintained.

With regards to a pressure ratio of an intermediate pressure with respect to a suction pressure (hereinafter, will be referred to as an intermediate pressure ratio Pm/Ps), FIG. 8A shows that an intermediate pressure ratio is constantly increased when the compressor is driven, and the increased intermediate pressure ratio is maintained during an operation time. On the other hand, FIG. 8B shows that an intermediate pressure ratio is excessively increased and lowered when the compressor is driven, and the intermediate pressure ratio is drastically lowered with the discharge pressure ratio after being maintained for a predetermined time.

The reason is because leakage from a space between compression chambers occurs at a region near a central part, as the first back pressure chamber (S1) is not formed due to an operation delay (or delay of an upward movement) or a non-operation of the sealing member in case of FIG. 8B. The reason why a pressure of the second back pressure chamber (S2) which forms an intermediate pressure space is temporarily increased is as follows. Firstly, high-pressure oil is introduced into the second back pressure chamber (S2) as the first back pressure chamber (S1) is not formed, and a pressure of the second back pressure chamber (S2) is temporarily increased due to the high-pressure oil. During this process, a back pressure force is generated to some degree. However, since the pressure of the back pressure chamber is lower than a discharge pressure of the compression chamber, leakage occurs from a space between the compression chambers.

In this embodiment, as aforementioned, an interval between the sealing member 36 and the sealing member insertion groove 336 is optimized such that an operation delay of the sealing member 36 is prevented. FIG. 9 is a graph showing a change of a compression ratio according to a ratio (%) (hereinafter, an interval ratio) of a radial interval (especially, a second interval) of the sealing member, with respect to an outer diameter of the sealing member insertion groove.

As shown, when the interval ratio is less than 0.05% and more than 1.0%, the change of the compression ratio is drastically increased. Accordingly, the interval ratio is preferably formed to be within a range of 0.05~1.0%.

An operation of the sealing member according to this embodiment is variable according to a shape of the sealing member.

That is, if the first sealing portion 361 is too thin, reliability may be lowered due to a low abrasion resistance. On the other hand, if the first sealing portion 361 is too thick, an operation delay may occur due to a heavy weight.

If the second sealing portion 362 is too thin, reliability may be lowered, and a sealing force may be lowered because the sealing member is excessively sensitive to a pressure change of the first back pressure chamber (S1). On the other hand, if the second sealing portion 362 is too thick, a sealing force may be lowered as a transformation due to a pressure difference between inside and outside of the sealing member 36 is not smooth.

Figure 10:
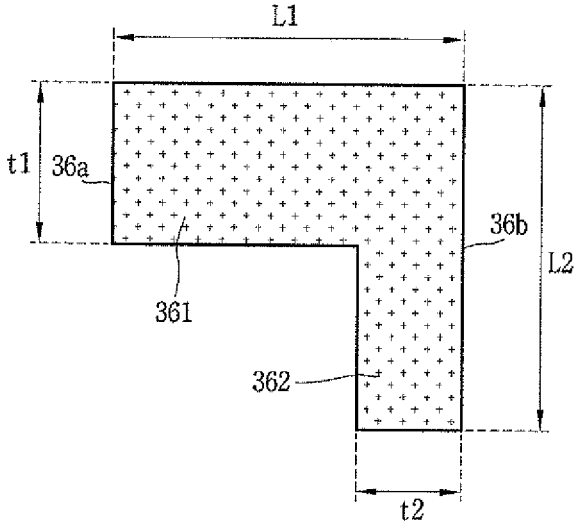

Accordingly, for enhanced reliability and sealing force, the first sealing portion 361 and the second sealing portion 362 are preferably formed to have a proper size. FIG. 10 is a schematic view for explaining a size of the sealing member according to this embodiment.

As shown, the first sealing portion 361 of the sealing member according to this embodiment may be formed such that a radial width (L1) may be larger than or equal to an axial thickness (t1). And the second sealing portion 362 may be formed such that a radial thickness (t2) may be smaller than or equal to an axial length (L2).

And the axial thickness (t1) of the first sealing portion 361 may be greater than the radial thickness (t2) of the second sealing portion 362. With such a configuration, a shortened lifespan of the first sealing portion 361 due to abrasion with the frame 31 may be prevented, and a radial sealing effect may be enhanced since the second sealing portion 362 is rapidly transformable.

Further, the axial thickness (t1) of the first sealing portion 361 may be formed to be larger than or equal to a maximum interval (generally, an interval when the compressor is stopped) (G4) between the frame 31 and the second scroll 33 outside the sealing member 36 (at the second back pressure chamber side). As a result, the sealing member 36 (precisely, an outer circumferential surface of the first sealing portion) may be pushed to be bent towards the second back pressure chamber, by oil of the first back pressure chamber (S1). This may cause an edge of the outer circumferential surface 36*b* of the sealing member 36 to be positioned between the frame 31 and the second scroll 33.

In this embodiment, as shown in FIG. 11, a fitting prevention unit 336*c* which forms a first chamfering portion is formed at an edge of the sealing member insertion groove 336, thereby preventing the sealing member 36 from being positioned between the frame 31 and the second scroll 33.

The fitting prevention unit 336*c* may be formed to have a stair-stepped surface or a curved surface. However, the fitting prevention unit 336*c* may be formed to be inclined with consideration of a processability, etc.

Further, the fitting prevention unit 336*c* is preferably formed such that a height (H3) of its lower end, i.e., a region contacting the outer side wall surface 336*b* of the sealing member insertion groove 336, is within a range of the first sealing portion 361 at least when the sealing member 36 contacts the frame 31. With such a configuration, even if the sealing member 36 is to be pushed by a pressure of the first back pressure chamber (S1) in a contacted state to the frame 31, the first sealing portion 361 which is relatively thicker may not be outward pushed by enduring the pressure of the first back pressure chamber (S1).

Although not shown, the fitting prevention unit 336*c* may be formed at an edge of an outer circumferential surface of the sealing member, or may be formed at an edge of the sealing member insertion groove and an edge of the sealing member, respectively.

Since the sealing member 36 according to this embodiment is formed to have a '¬'-shaped sectional surface as aforementioned, the first sealing portion 361 which forms a frictional surface has a smaller thickness than the conventional sealing member having a quadrangular sectional surface. Accordingly, the sealing member 36 is preferably formed of a material having an abrasion resistance.

For this, the sealing member 36 according to this embodiment may be formed of Teflon (PEFE) to which an abrasion-resistant additive is added. As the abrasion-resistant additive, powder particles or carbon fibers may be used.

For an enhanced abrasion resistance, carbon fibers not powder particles may be preferably used. The reason is because it is easier for powder particles to be separated from Teflon, than for carbon fibers to be broken.

The sealing member 36 may further include a lubricant additive such as graphite. In this case, the sealing member 36 may have its abrasion degree significantly reduced due to an enhanced lubricity.

As aforementioned, the first back pressure chamber (S1) is formed between a lower surface of the frame 31 and an upper surface of the second disk portion 331 of the second scroll 33. For this, a stair-stepped surface for forming the first back pressure chamber (S1) is formed on the lower surface of the frame 31 or on the upper surface of the second disk portion 331 (on the second disk portion in the drawings).

That is, as shown in FIG. 7, a second scroll height (H1) inside the sealing member insertion groove 336, i.e., a height of a side where the first gap (G1) is formed, is lower than a second scroll height (H2) outside the sealing member insertion groove 336, i.e., a height of a side where the second gap (G2) is formed.

With such a configuration, an inner side surface 331*b*, positioned at an inner side than the sealing member insertion groove 336 on a rear surface of the second disk portion 331, is lower than an outer side surface 331*c* positioned at an outer side than the sealing member insertion groove 336 and forming a thrust bearing surface. As a third gap (G3) between the frame 31 and the second scroll 33 inside the sealing member insertion groove 336 which is directly connected to the first gap (G1) is formed to be larger than a fourth gap (G4) between the frame 31 and the second scroll 33 outside the sealing member insertion groove 336 which is directly connected to the second gap (G2), a space where the first back pressure chamber (S1) is formed may be provided on the inner side surface 331*b* of the second disk portion 331. Further, high-pressure fluid may be rapidly introduced to the first gap (G1).

As shown in FIG. 12, an oil guiding portion 336*d*, which forms a second chamfering portion and configured to guide oil to the sealing member insertion groove 336, may be formed at an edge of the sealing member insertion groove 336. The oil guiding portion 336*d* forms a chamfering portion at an edge where the inner side surface 331*b* of the second scroll 33 is connected to the inner side wall surface 336*a* of the sealing member insertion groove 336, thereby rapidly introducing a high-pressure fluid into the sealing member insertion groove 336.

In the scroll compressor according to this embodiment, once the scroll compressor starts to be driven, the compression unit 30 sucks and compresses a refrigerant, and discharges the high-pressure refrigerant to the intermediate space 10*a* of the casing 10.

As shown in FIG. 13A, the high-pressure refrigerant is introduced into the sealing member insertion groove 336 via a space between the frame 31 and the orbiting scroll 33, together with oil. And the high-pressure refrigerant pressurizes a lower surface of the first sealing portion 361 of the sealing member 36, and an inner circumferential surface of the second sealing portion 362.

As shown in FIG. 13B, as the sealing member 36 is upward moved by a pressure applied to a lower surface of the first sealing portion 361, an upper surface of the first sealing portion 361 and a lower surface of the frame 310 are adhered to each other. As a result, the sealing member 36 performs a sealing function in an axial direction. As the orbiting scroll 33 performs an orbiting movement, the first sealing portion 361 performs an orbiting movement as its upper surface slidably-contacts a lower surface of the frame 31 (a thrust bearing surface). This may cause the first sealing portion 361 to have a lowered reliability due to abrasion occurring between the first sealing portion 361 and the frame 31 when the scroll compressor is operated for a long time. However, since the axial thickness (t1) of the first sealing portion 361 is larger than the radial thickness (T2) of the second sealing portion 362 at least, the sealing member 36 may have a long lifespan.

Further, the second sealing portion 362 is outward bent by a pressure applied to an inner circumferential surface of the second sealing portion 362, thereby being adhered to the outer side wall surface 336*b* of the sealing member insertion groove 336. As a result, the sealing member 36 performs a sealing function in a radial direction.

The second sealing portion 362 is formed as a ring-shaped single body having no cut-out portion, and is upward moved by a pressure of the sealing member insertion groove 336. Accordingly, if the radial thickness (t2) of the second sealing portion 362 is too large, the second sealing portion 362 may not be bent when the compressor is driven, resulting in leakage in a radial direction.

However, if the radial thickness (t2) of the second sealing portion 362 is smaller than the axial thickness (t1) of the first sealing portion 361 at least, the second sealing portion 362 may be rapidly bent when the compressor is driven, thereby performing a sealing function in a radial direction of the sealing member insertion groove 336. This may enhance performance of the compressor.

Other embodiments of the sealing member according to the present invention will be explained.

In the aforementioned embodiment, the sealing member is formed such that an outer diameter of the first sealing portion is the same as an outer diameter of the second sealing portion. However, in this embodiment, the outer diameter of the first sealing portion is formed to be different from the outer diameter of the second sealing portion.

For instance, as shown in FIG. 14, the outer diameter (D31) of the first sealing portion 361 may be formed to be larger than the outer diameter (D32) of the second sealing portion 362. As a result, a stair-stepped surface 36*c* is formed at a contact region between an outer circumferential surface 361*b* of the first sealing portion 361 and an outer circumferential surface 362*b* of the second sealing portion 362. And an outer circumferential surface 361*c* of the first sealing portion 361 forms a frictional surface with respect to the outer side wall surface 336*b* of the sealing member insertion groove 336.

With such a configuration, an axial length (L21) of the sealing member 36 which forms a radial frictional surface of the sealing member 36 may be reduced to the axial thickness (t1) of the first sealing portion 361. This may reduce an operation delay of the sealing member 36 to some degree even if the second gap (G2) is more reduced than in the aforementioned embodiment.

As shown in FIG. 15, the outer diameter (D31) of the first sealing portion 361 may be formed to be much smaller than the outer diameter (D32) of the second sealing portion 362. This is opposite to the case according to the aforementioned embodiment shown in FIG. 14. In this case, the stair-stepped surface 36*c* is formed at a contact region between the outer circumferential surface 361*b* of the first sealing portion 361 and the outer circumferential surface 362*b* of the second sealing portion 362. However, a substantial frictional surface is mainly formed on the outer circumferential surface 362*b* of the second sealing portion 362. Accordingly, an axial length (L22) of the sealing member 36 which forms a radial frictional surface of the sealing member 36 may be reduced to a length except for most of the axial thickness (t1) of the first sealing portion 361. This may reduce an operation delay of the sealing member 36 to some degree even if the second gap (G2) is more reduced than in the aforementioned embodiment.

Other embodiments of the sealing member according to the present invention will be explained.

In the aforementioned embodiment, each of the first sealing portion and the second sealing portion is formed to have the same sectional surface. However, in this embodiment, the second sealing portion is formed to have a different sectional surface in an axial direction.

For instance, as shown in FIG. 16, an inclined surface 362*c* may be formed on an inner circumferential surface of the second sealing portion 362 such that a sectional surface may be reduced towards a lower end from an upper end of the second sealing portion 362. Alternatively, as shown in FIG. 17, a pressing portion 362*d* may be formed at a contact region between an inner circumferential surface of the second sealing portion 362 and a lower surface of the first sealing portion 361.

In such cases, thicknesses (t21) (t22) of a lower end of the second sealing portion 362 in a radial direction are preferably formed to be smaller than the axial thickness (t1) of the first sealing portion 361.

The sealing member according to these embodiments has a basic configuration and an operation effect which are similar to those of the aforementioned embodiment, and thus detailed explanations thereof will be omitted.

In the embodiment shown in FIG. 16, the thickness (t21) of the lower end of the second sealing portion 362 in a radial direction is formed to be smaller than that shown in FIG. 10, and the second sealing portion 362 may obtain an area where a pressure can be applied in an axial direction, at a lower end thereof. This may allow not only a radial sealing force but also an axial sealing force, to be obtained. In the embodiment shown in FIG. 17, the thickness (t22) of the lower end of the second sealing portion 362 in a radial direction is formed to be significantly small to enhance a radial sealing effect. As a result, an area where a pressure can be applied in an axial direction by the pressing portion 362*d* may be obtained, and thus an axial sealing force may be obtained.

Other embodiments to upward move the sealing member in the scroll compressor according to the present invention will be explained as follows.

In the aforementioned embodiments, the sealing member is upward moved by a pressure of a fluid introduced into the sealing member insertion groove. However, in this embodiment, as shown in FIG. 18, an elastic member 365 is installed at the sealing member insertion groove 336 such that the sealing member 36 is upward moved by an elastic force of the elastic member 365.

In this case, as the sealing member 36 is upward moved by the elastic member 365, the sealing member 36 may be rapidly upward-moved even when the compressor is driven, thereby enhancing an axial sealing force.

Although not shown, a region between a lower surface of the first sealing portion and an inner circumferential surface of the second sealing portion may be formed to have a curved surface. This may prevent damage of a region between the first and second sealing portions.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a first scroll;

a second scroll which forms a compression chamber together with the first scroll while performing an orbiting movement with respect to the first scroll;

a frame configured to support the second scroll by being coupled to the first scroll;

a sealing member insertion groove formed in a ring shape, on at least one of one side surface of the second scroll and one side surface of the frame contacting the second scroll; and a sealing member formed in a ring shape, inserted into the sealing member insertion groove, and configured to divide an interval between the second scroll and the frame, wherein the sealing member is formed such that a sectional surface of an inner circumferential surface thereof is smaller than that of an outer circumferential surface thereof, and such that a second gap between the outer circumferential surface of the sealing member and an outer side wall surface of the sealing member insertion groove is smaller than or equal to a first gap between the inner circumferential surface of the sealing member and an inner side wall surface of the sealing member insertion groove, wherein the sealing member includes:

a first sealing portion that has a first ring shape, the first sealing portion having a first surface that defines an axial sealing surface facing the frame, and a second sealing portion that has a second ring shape and extends from a second surface of the first sealing portion in a direction away from the frame, the second sealing portion having an outer circumferential surface that defines a radial sealing surface facing the outer side wall surface of the sealing member insertion groove, and wherein an outer diameter of the first sealing portion is different from an outer diameter of the second sealing portion.

2. The scroll compressor of claim 1, wherein the second gap is formed to be 0.05~1.0% with respect to an outer diameter of the sealing member.

3. The scroll compressor of claim 1, wherein a first chamfering portion is formed on at least one of an outer edge of the sealing member insertion groove and an outer edge of the sealing member.

4. The scroll compressor of claim 3, wherein the sealing member includes:

a first sealing portion formed in a ring shape, and having one surface forming an axial sealing surface with the frame; and a second sealing portion extended from another surface of the first sealing portion in a ring shape, and having an outer circumferential surface forming a radial sealing surface with the outer side wall surface of the sealing member insertion groove, and wherein an axial height of the first chamfering portion is formed to be smaller than or equal to an axial thickness of the first sealing portion.

5. The scroll compressor of claim 1, wherein a stair-stepped surface is defined at a boundary between an outer circumferential surface of the first sealing portion and the outer circumferential surface of the second sealing portion.

6. The scroll compressor of claim 5, wherein the second gap is formed to be 0.05~1.0% with respect to an outer diameter of the sealing member.

7. The scroll compressor of claim 1, wherein the sealing member is formed of Teflon (PEFE) mixed with carbon fibers.

8. The scroll compressor of claim 7, wherein the sealing member further includes a graphite material.

9. The scroll compressor of claim 1, wherein the sealing member is formed to have a '¬'-shaped sectional surface, and a part of the sealing member contacting the frame has a larger thickness than a part of the sealing member contacting the sealing member insertion groove.

10. The scroll compressor of claim 1, wherein a gap between the second scroll and the frame is formed such that an inner interval is larger than an outer interval in a radius direction based on the sealing member insertion groove, and wherein a first passage for communicating the inner interval and the outer interval with each other is formed at the second scroll or the frame.

11. The scroll compressor of claim 10, wherein a second passage for communicating the outer interval with the compression chamber is formed at the first scroll or the frame.

12. A scroll compressor, comprising:

a casing having an inner space where oil is stored;

a driving motor provided at the inner space of the casing;

a rotation shaft coupled to the driving motor;

a frame provided below the driving motor;

a first scroll provided below the frame, and having a first wrap on one side surface thereof;

a second scroll having a sealing member insertion groove on a surface thereof contacting the frame, provided between the frame and the first scroll, having a second wrap engaged with the first wrap, eccentrically-coupled to the rotation shaft such that the rotation shaft is overlapped with the second wrap, and forming compression chambers at a space between the second scroll and the first scroll while performing an orbiting movement with respect to the first scroll; and a sealing member formed in a ring shape, inserted into the sealing member insertion groove, provided between the frame and the second scroll, and configured to divide an interval between the frame and the second scroll into an inner interval and an outer interval, wherein a stair-stepped surface is defined at an outer circumferential surface of the sealing member and faces an outer side wall surface of the sealing member insertion groove, and wherein the outer side wall surface of the sealing member insertion groove maintains one outer diameter along the outer circumferential surface of the sealing member in an axial direction of the second scroll.

13. The scroll compressor of claim 12, wherein a plurality of oil passages for guiding the oil stored in the casing to an outer circumferential surface of the rotation shaft are formed at the rotation shaft, and wherein at least one of the plurality of oil passages is formed to be communicated with the inner interval.

14. The scroll compressor of claim 13, wherein the outer interval is communicated with a compression chamber which forms an intermediate pressure between a suction pressure and a discharge pressure, among the compression chambers, wherein a communication passage for communicating the inner interval and the outer interval with each other is further provided at the second scroll or the frame, and wherein a pressure reducing rod is provided at the communication passage.

15. The scroll compressor of claim 14, wherein the interval between the frame and the second scroll is formed such that the outer interval is smaller than the inner interval, and wherein a chamfering portion inclined towards the sealing member insertion groove is formed at an edge of the sealing member insertion groove contacting the outer interval.

16. The scroll compressor of claim 12, wherein the sealing member is formed of Teflon (PEFE) mixed with carbon fibers.

17. The scroll compressor of claim 16, wherein the sealing member further includes a graphite material.

18. A scroll compressor, comprising:

a first scroll;

a second scroll which forms a compression chamber together with the first scroll while performing an orbiting movement with respect to the first scroll;

a frame configured to support the second scroll by being coupled to the first scroll;

a sealing member insertion groove formed in a ring shape, on at least one of one side surface of the second scroll and one side surface of the frame contacting the second scroll; and a sealing member formed in a ring shape, inserted into the sealing member insertion groove, and configured to divide an interval between the second scroll and the frame, wherein the sealing member includes:

a first sealing portion having a ring shape, the first sealing portion having one surface that defines an axial sealing surface with the frame, and a second sealing portion that extends from another surface of the first sealing portion and that has a ring shape, the second sealing portion having an outer circumferential surface that defines a radial sealing surface facing an outer side wall surface of the sealing member insertion groove, and wherein a stair-stepped surface is defined at an outer circumferential surface of the sealing member at a boundary between an outer circumferential surface of the first sealing portion and an outer circumferential surface of the second sealing portion.

19. The scroll compressor of claim 18, wherein an outer diameter of the first sealing portion is greater than an outer diameter of the second sealing portion.

20. The scroll compressor of claim 18, wherein an outer diameter of the second sealing portion is greater than an outer diameter of the first sealing portion.

* * * * *